US006560900B2

(12) United States Patent
Bray, Jr. et al.

(10) Patent No.: US 6,560,900 B2
(45) Date of Patent: May 13, 2003

(54) SLIPPER AND METHOD FOR MANUFACTURING SLIPPER

(75) Inventors: Walter Thomas Bray, Jr., Reynoldsburg, OH (US); Theresa Stewart, Columbus, OH (US)

(73) Assignee: R. G. Barry Corporation, Pickerington, OH (US)

( * ) Notice: Subject to any disclaimer, the term of this patent is extended or adjusted under 35 U.S.C. 154(b) by 0 days.

(21) Appl. No.: 09/822,633

(22) Filed: Mar. 30, 2001

(65) Prior Publication Data

US 2001/0010128 A1 Aug. 2, 2001

Related U.S. Application Data

(62) Division of application No. 09/075,760, filed on May 11, 1998, now Pat. No. 6,226,894.

(51) Int. Cl.[7] ..... A43B 3/12; A43B 9/10; A43B 9/02; A43B 13/28; A43D 43/60

(52) U.S. Cl. ..... 36/17 A; 36/11.5; 36/16; 36/18; 36/19 R; 12/142 B; 12/142 C; 12/142 T

(58) Field of Search ..... 36/11.5, 17 A, 36/8.4, 14, 10, 16, 18, 26, 9 R, 11, 21, 19 R, 25 R, 29, 3 B, 44; 12/142 B, 142 C, 142 E, 142 MC, 142 RS, 142 T

(56) References Cited

U.S. PATENT DOCUMENTS

| | | | | |
|---|---|---|---|---|
| 992,221 A | | 5/1911 | Loewenbach | |
| 1,120,808 A | | 12/1914 | Goldberg | |
| 1,419,676 A | | 6/1922 | Koch | |
| 1,491,086 A | | 4/1924 | Dessau | |
| 1,770,698 A | | 7/1930 | Horowitz | |
| 1,916,067 A | | 6/1933 | Naidor | |
| 1,973,292 A | | 9/1934 | Littell et al. | |
| 2,173,702 A | * | 9/1939 | Winkel | 36/11.5 |
| 2,299,500 A | | 10/1942 | Sawyer | |
| D155,956 S | | 11/1949 | Wood | |

(List continued on next page.)

FOREIGN PATENT DOCUMENTS

| | | | | |
|---|---|---|---|---|
| JP | 5-111403 | | 5/1993 | |
| WO | WO 94/08478 | * | 4/1994 | 36/10 |

OTHER PUBLICATIONS

Dearfoams®, Spring/Summer 1993 Catalog plus price lists (14 pgs.).
Dearfoams®, Fall/Winter 1993 Catalog (16 pgs.).
Dearfoams® Catalog, P. 4, item DF820, Clog (Fall/Winter 1993).
Dearfoams® Slippers, Spring/Summer 1994 Catalog (8 pgs.).
Dearfoams® Slippers, Fall/Winter 1994 Catalog (8 pgs.).
Dearfoams® for Women, Spring/Summer 1995 Promotional Brochure (6 pgs.).
Dearfoams®, Fall/Winter 1995 Promotional Brochure (8 pgs.).
Dearfoams® Catalog, p. 5, item DF615, Slipper (Fall/Winter 1995).
Dearfoams®, Fall/Winter 1996 Promotional Brochure (8 pgs.).

*Primary Examiner*—Anthony D. Stashick
(74) *Attorney, Agent, or Firm*—Merchant & Gould P.C.

(57) ABSTRACT

A slipper and a method of manufacturing a slipper is described where the slipper includes an outsole having a sidewall extending along a perimeter of the outsole. The outsole also includes a supporting sole structure including a platform surface. The supporting sole may include lattice walls defining open cells. The slipper also includes an insole and a vamp. The insole covers the platform of the outsole and fits within the sidewall. The method of manufacture includes the steps of providing the outsole, providing the vamp, and attaching a lower perimeter of the vamp to at least a portion of the sidewall extending along a perimeter of the outsole.

21 Claims, 22 Drawing Sheets

U.S. PATENT DOCUMENTS

| | | | | | |
|---|---|---|---|---|---|
| D160,091 | S | | 9/1950 | Lacek | |
| 2,978,817 | A | | 4/1961 | Brenner | |
| 3,051,971 | A | | 9/1962 | Westberg | |
| 3,095,656 | A | | 7/1963 | Lipare | |
| 3,221,422 | A | * | 12/1965 | Lemeshnik | 36/9 R |
| 3,289,329 | A | | 12/1966 | Weiss | |
| 3,416,174 | A | | 12/1968 | Novitske | |
| 4,020,569 | A | | 5/1977 | Fukuoka | |
| 4,133,118 | A | * | 1/1979 | Khalsa et al. | 36/29 |
| 4,145,822 | A | | 3/1979 | Mitchell et al. | |
| 4,236,327 | A | * | 12/1980 | Gorsche et al. | 36/14 |
| 4,250,638 | A | | 2/1981 | Linnemann | |
| 4,348,820 | A | | 9/1982 | D'Allessio | |
| 4,355,473 | A | | 10/1982 | Ilitzky | |
| 4,369,537 | A | | 1/1983 | Midgley | |
| 4,586,209 | A | | 5/1986 | Bensley | |
| 4,590,690 | A | * | 5/1986 | Pfander | 36/18 |
| 4,899,412 | A | | 2/1990 | Ganon | |
| 4,955,147 | A | | 9/1990 | Bos | |
| 4,972,610 | A | | 11/1990 | Tong | |
| 5,012,541 | A | * | 5/1991 | Ganon | 36/9 R |
| 5,033,144 | A | * | 7/1991 | Ganon | 36/9 R |
| D326,181 | S | | 5/1992 | Katz et al. | |
| 5,203,792 | A | | 4/1993 | Kaiser | |
| D347,518 | S | | 6/1994 | Stewart | |
| 5,392,532 | A | * | 2/1995 | Bray, Jr. et al. | 36/11.5 |
| 5,452,527 | A | | 9/1995 | Gaylord | |
| 5,483,757 | A | | 1/1996 | Frykberg | |
| 5,491,860 | A | * | 2/1996 | Bray et al. | 36/10 |
| 5,621,986 | A | | 4/1997 | Medina et al. | |
| 5,644,856 | A | * | 7/1997 | Bray, Jr. | 36/11.5 |
| D401,049 | S | | 11/1998 | Greenberg | |
| 5,896,677 | A | * | 4/1999 | Barsorian | 36/11.5 |

* cited by examiner

SLIPPER AND METHOD FOR MANUFACTURING SLIPPER

CROSS-REFERENCE TO RELATED APPLICATION

The present application is a divisional application of U.S. Ser. No. 09/075,760 filed May 11, 1998 now U.S. Pat. No. 6,226,894, which application is incorporated herein by reference.

FIELD OF THE INVENTION

This invention pertains to footwear. More particularly, this invention pertains to a slipper having a molded outsole, and to a method for manufacturing a slipper having a molded outsole.

BACKGROUND OF THE INVENTION

The footwear industry is an old and crowded art. The industry is constantly attempting to design new products with aesthetic appeal, as well as being comfortable and having ease of construction.

Various designs of slippers have been available for a number of years. In general, slippers are a type of footwear having a generally soft construction and which are generally washable in a conventional clothes washing machine. Slippers are typically not manufactured using a last, which is often a necessary device when manufacturing a shoe, including a hard sole and a leather upper.

SUMMARY OF THE INVENTION

A slipper having a molded outsole is provided according to the present invention. The outsole includes a sidewall extending along a perimeter of the outsole and includes a supporting sole structure having a platform surface. A heel region, an instep region and a toe region are present in the outsole. The slipper also includes an insole that covers the platform surface of the outsole, within the sidewall extending along a perimeter of the outsole. The slipper further includes a vamp that is stitched to at least a toe region of the sidewall.

The supporting sole structure of the outsole preferably defines open cell areas. The outsole has a thickness across its length, that is thickest in the heel region, defining a wedge shape of the outsole. In one embodiment, the vamp may include a molded polymeric material. In another embodiment, the vamp may be a fabric vamp having two forward projections stitched together and two rearward projections stitched together, and having a perimeter that is sewn to the sidewall extending along the outsole.

A method of manufacture of a slipper is also provided by the present invention. The method includes providing an outsole having a sidewall extending along a perimeter of the outsole and a supporting sole structure including a platform surface. The method also includes providing a vamp and attaching at least a portion of a lower perimeter of the vamp to the sidewall of the outsole. In one embodiment of the method of manufacture of a slipper, a molded polymeric vamp may be attached by inverting the vamp, stitching the lower perimeter of the vamp to the sidewall at the toe and instep regions, and turning the vamp so that the lower perimeter of the vamp is positioned inside the sidewall. In another embodiment of the method, a fabric vamp has a perimeter that is stitched to the sidewall extending along a perimeter of the outsole.

DETAILED DESCRIPTION OF THE VARIOUS EMBODIMENTS

Figure 1:
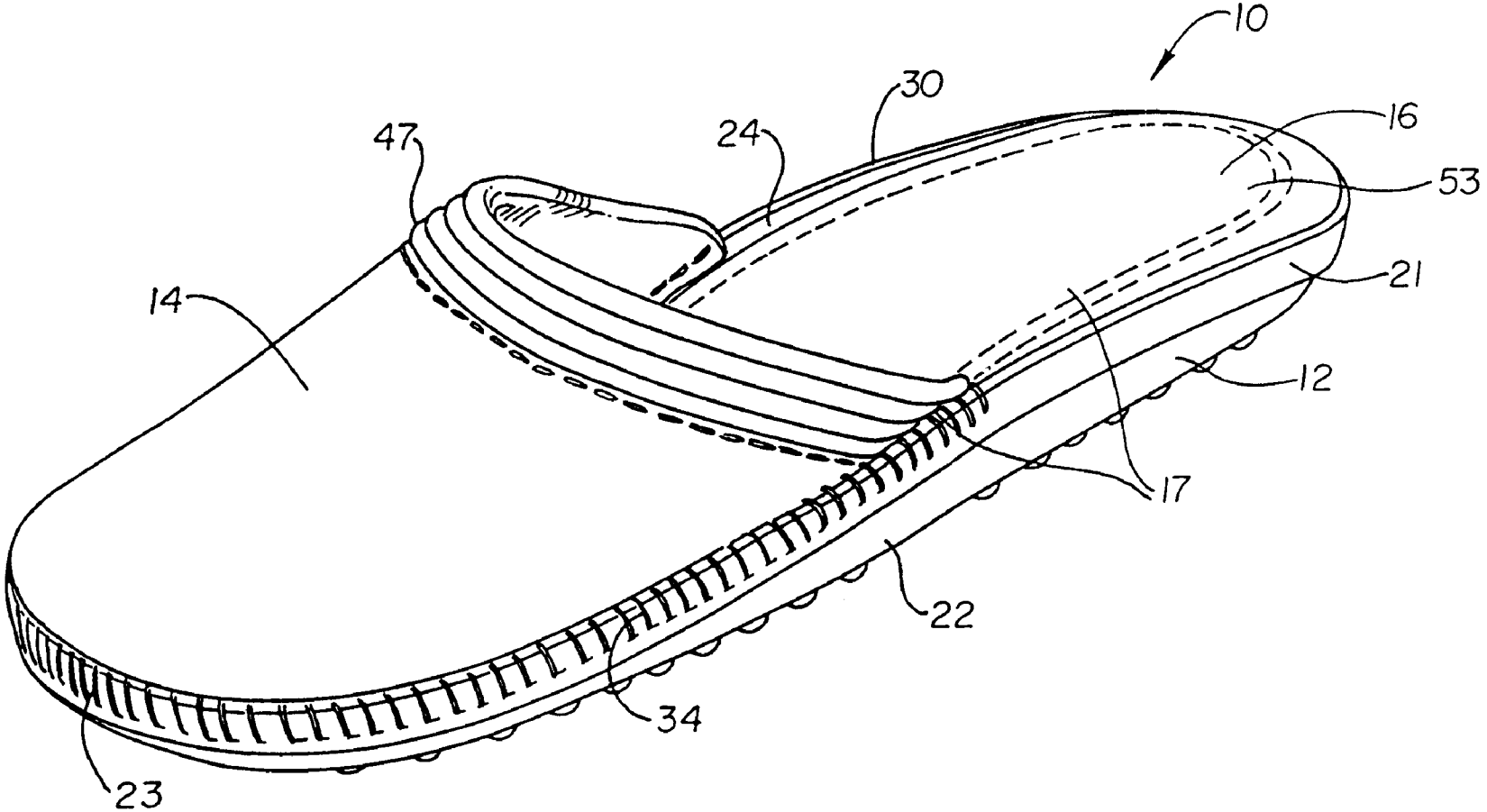
FIG. 1 is a perspective view of an assembled slipper of the present invention intended to be worn on the left foot, where the right foot construction is substantially a mirror image of FIG. 1.

Referring now to the several figures in which identical elements are numbered identically throughout, a brief description of the preferred embodiments of the present invention will now be provided. Referring now to FIG. 1, a slipper 10 constructed according to the present invention is shown. The slipper 10 has a general clog type appearance. That is, it looks like a clog but does not include the wooden sole normally found in conventional clogs. The slipper 10 can be referred to as the closed toe slipper because the wearer's toe is covered when the slipper is worn. In contrast, alternative designs of the slipper of the invention include an open toe slipper using a fabric upper provided at reference numeral 100 in FIG. 24 that exposes the wearer's toes when the slipper is worn. Two additional style slippers can be referred to as the molded sandal and the molded open toe slipper and are provided at reference numeral 150 in FIG. 14 and at reference numeral 200 in FIG. 15 because they may use an upper of a molded polymeric material.

One embodiment of the closed toe slipper 10 is also described in U.S. Design Pat. Des. No. 514,606, titled MOLDED SLIPPER, which is incorporated herein by reference in its entirety. One embodiment of the open toe slipper 100 is described in U.S. Design Pat. Des. No. 418,281, titled OPEN TOE SLIPPER, which is incorporated herein by reference in its entirety.

The slipper 10 includes three general components which can be identified as the outsole 12, the vamp 14, and the insole 16. The outsole 12 provides a flexible and durable structure which resists wear. A combination of the vamp 14 and the insole 16 can be referred to as the upper 17. It will be appreciated that these various slipper designs can advantageously incorporate an outsole having several features.

Figure 2:
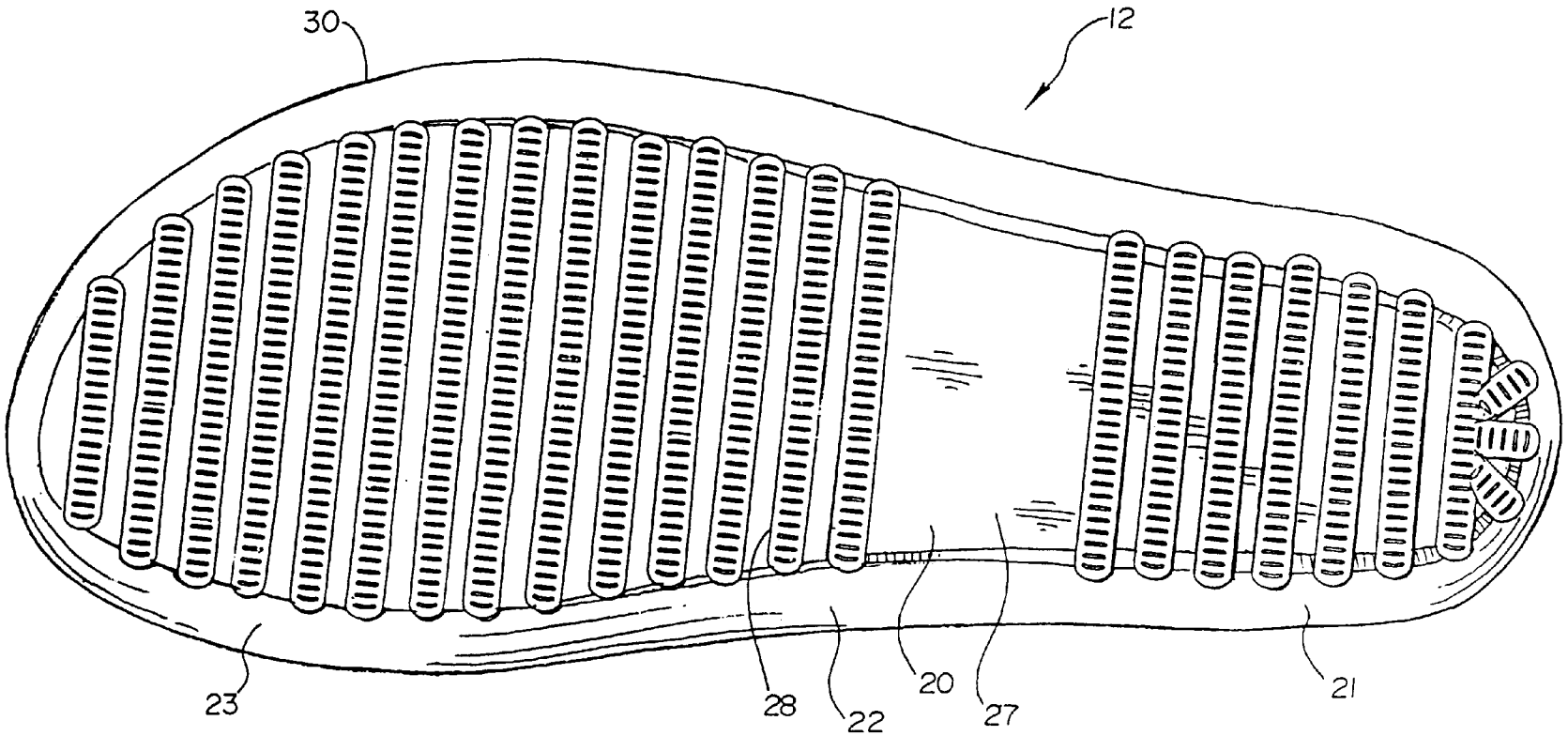
FIG. 2 is a bottom plan view of the outsole of the slipper of FIG. 1.
Figure 3:
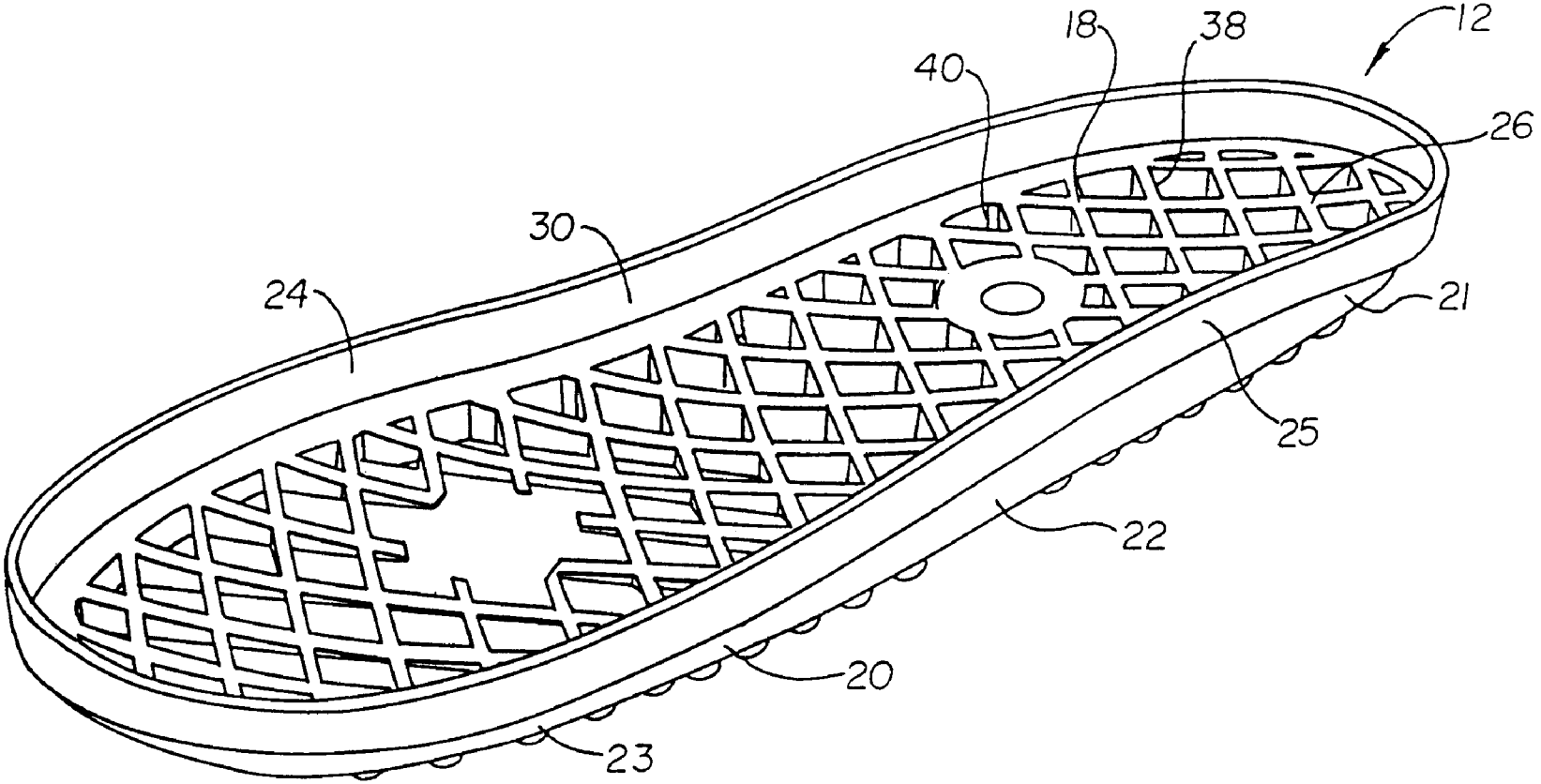
FIG. 3 is a perspective view of the outsole of the slipper of FIG. 1.
Figure 4:
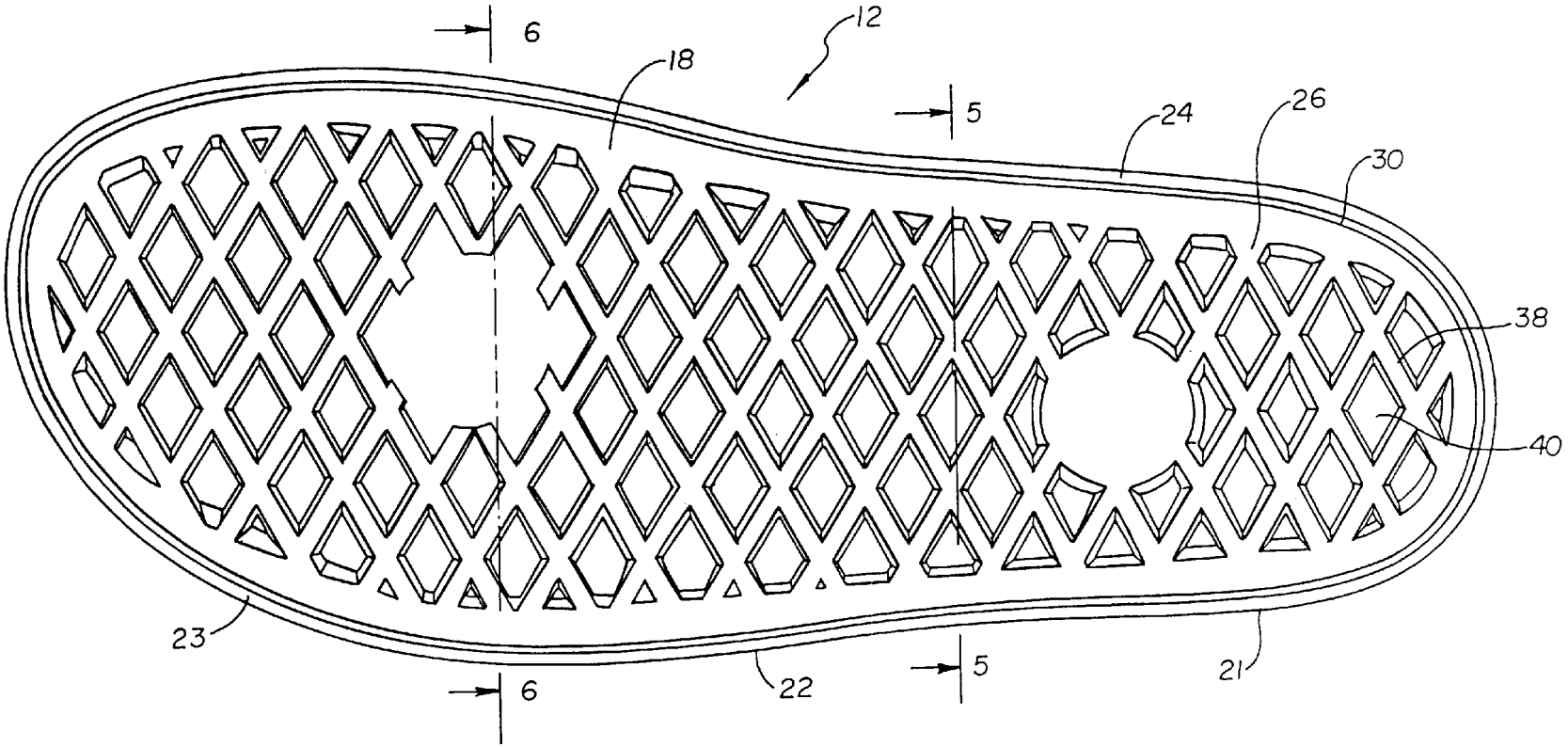
FIG. 4 is a top plan view of the outsole of the slipper of FIG. 1.
Figure 5:
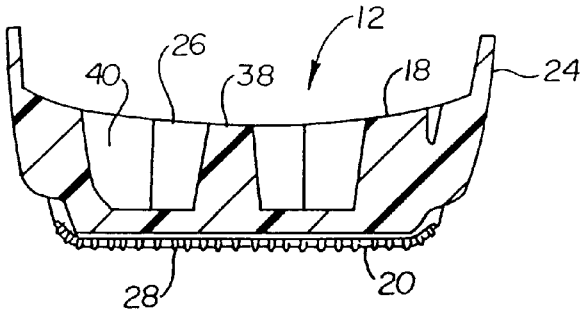
FIG. 5 is a sectional elevation view of the outsole of the slipper of FIG. 1, taken along line 5—5 in FIG. 4.
Figure 6:
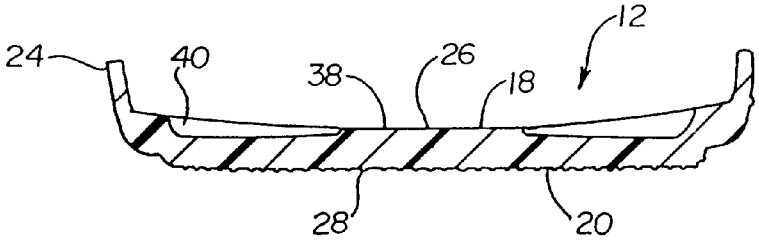
FIG. 6 is a sectional elevation view of the outsole of the slipper of FIG. 1, taken along line 6—6 in FIG. 4.
Figure 10:
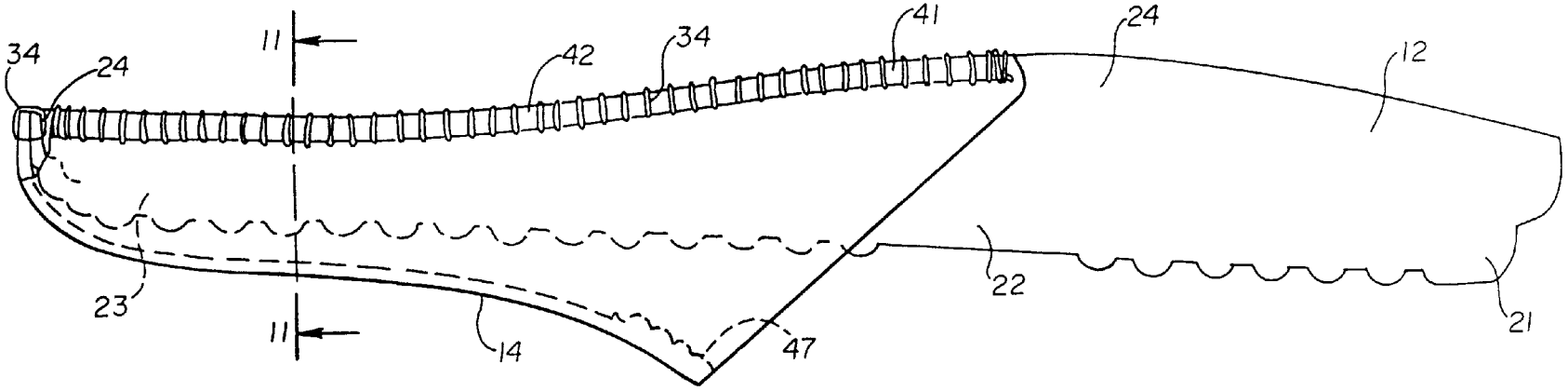
FIG. 10 is a side elevational view of the vamp and the outsole of the slipper of FIG. 1 during assembly.

Now referring to FIGS. 2–6, the outsole 12 is described in detail. The outsole 12 includes an exterior surface 20, sidewall 24, and supporting sole structure 26. The exterior surface 20 includes an outsole side surface 25 and an outsole bottom surface 27. The outsole bottom surface 27 has a tread pattern 28. It should be understood that while the tread pattern 28 shown in FIG. 2 is a preferred tread pattern, the variety of tread patterns available for use in the present invention are numerous, and it is expected that these numerous tread patterns can be used in the slipper of the invention. The sidewall 24 extends about the perimeter 30 of the slipper 10, meaning that the sidewall 24 may be present at a portion of the outsole perimeter 30, or at the entire outsole perimeter 30. One purpose for the sidewall 24 is to help retain the insole 16 within the slipper, framing a platform surface 18 on which the insole 16 rests. In addition, the purpose of the sidewall is to provide a lip which can receive stitching 34, as shown in FIG. 10, for attaching the vamp to the outsole 12. It should be understood that the minimum height of the sidewall 24 is provided to accommodate the thickness of the insole 16.

The supporting sole structure 26 is preferably provided with a honeycomb construction composed of the lattice walls 38 and the open cells 40. In general, this means that the supporting sole 26 provides sufficient structural integrity to support the wearer's weight without being crushed, while providing a reduced amount of material compared with a completely filled supporting sole structure.

The supporting sole structure 26 preferably includes a series of lattice walls 38 and cells or open areas 40. It is desirable to provide the supporting sole 26 with the desired degree of structural integrity, but at a much lighter weight compared with a supporting sole which is entirely filled, such as a wood supporting sole. In addition, it should be understood that while the honeycomb construction is preferred within the supporting sole 26, the invention can be practiced with a continuous material within the supporting sole 26. That is, the supporting sole 26 need not include the cells and open areas 40.

The outsole 12 includes a heel portion 21, an instep region 22, and a toe region 23. The outsole is preferably designed to provide the silhouette and support of a wedge shape, which is aesthetically desirable and comfortable for the wearer. Currently, many shoes or slippers use a separate foam or wooden wedge inside the outsole to achieve the wedge shape. However, wooden wedges increase the weight of a shoe or slipper. Separate wedge pieces of foam or wood may introduce an additional assembly step into the manufacturing process. A one-piece, molded outsole may therefore preferably be used with the present invention, providing the wedge advantage and simplifying the manufacture process. The outsole of the present invention has a thickness across its length, running from the toe region 23 to the heel region 21, that is thickest at the heel region 21. The lattice walls 38 are larger near the heel portion 21 of the outsole, in order to provide the wedge advantage.

Figure 11:
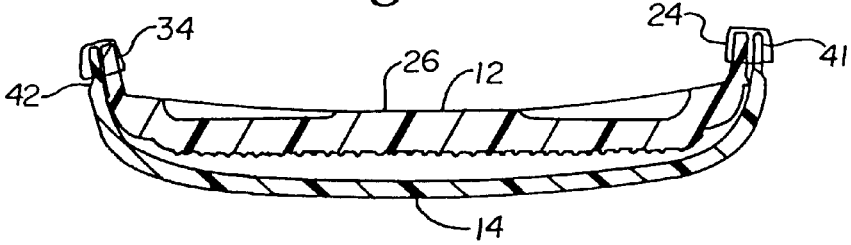
FIG. 11 is a sectional elevation of the vamp and outsole of the slipper of FIG. 1 during assembly taken along line 11—11 in FIG. 10.

The vertical sidewall 24 has a height defined as the distance from the platform surface 18 to the top of the sidewall 24. The height of the vertical sidewall 24 will be sufficient to provide a lip for stitching to the vamp lower perimeter 41, as shown in FIG. 11. In one embodiment of the present invention, the vertical sidewall 24 may have a height of about 1/16 inch to 1 inch. More preferably, the sidewall 24 projects about 1/8 inch to 3/8 inch, or most preferably 5/16 inch. The outsole is preferably made of a moldable polymeric compound such as thermoplastic rubber, although many other materials are available.

Figure 7:
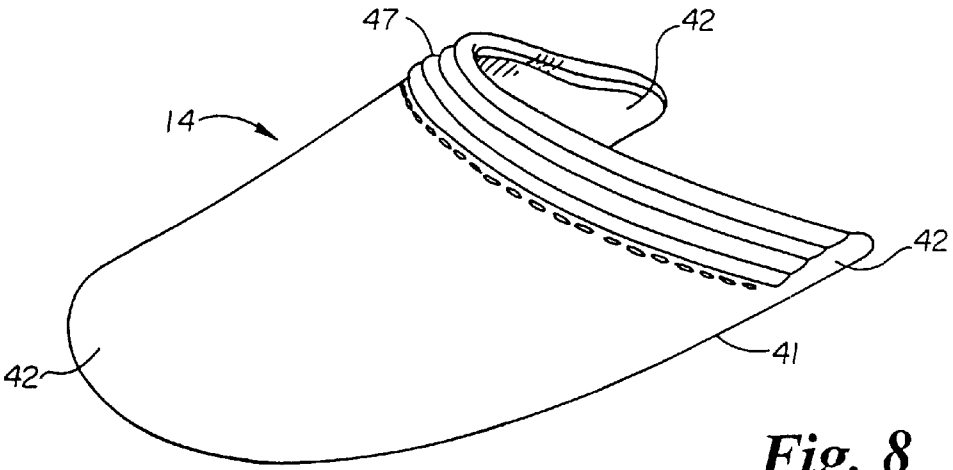
FIG. 7 is a perspective view of the vamp of the slipper of FIG. 1.

Now referring to FIG. 7, the vamp 14 is described in detail. The vamp 14 is designed such that the lower perimeter 41 of the vamp will fit within the contoured perimeter of the sidewall 24 of the molded outsole 12. The term 'lower perimeter' refers to the edge of the vamp that contacts the outsole in the assembled slipper of the present invention. The throat dimensions and design taper 42 along the bottom perimeter 41 of the vamp are designed to allow inverted attachment and turning of the upper to the outsole. The design taper 42 is located at the lower perimeter 41 of the vamp, where the vamp material is thinner than the remainder of the vamp. The vamp therefore fits inside the vertical sidewalls 24. This tapering allows reverse attachment of the upper to the outsole followed by turning of the upper, as will be illustrated. The vamp is preferably made of a moldable compound. The vamp 14 may include molded design elements 47. Although one embodiment of this product utilizes thermoplastic rubber as the moldable composition, other materials suitable for filling casts or tooled molds can be utilized to create the upper or the outsole.

The insole 16 is illustrated in FIGS. 16–22. The insole 16 is a padded structure designed to provide cushioning. The insole 16 includes foam and fabric material, for example, a layer of foam 44. Notches 43 of the foam layer 44 are used for alignment with other components. A fabric backing layer 53 may be provided on one or both sides of the foam layer 44, and is preferably present on the side of the foam layer 44 that will contact the wearer's foot as shown in FIG. 1.

Figure 18:
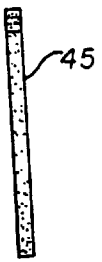
FIG. 18 is a side view of a heel filler of the slipper of FIG. 1.
Figure 19:
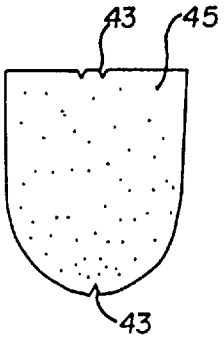
FIG. 19 is a top plan view of the heel filler of FIG. 18.
Figure 17:
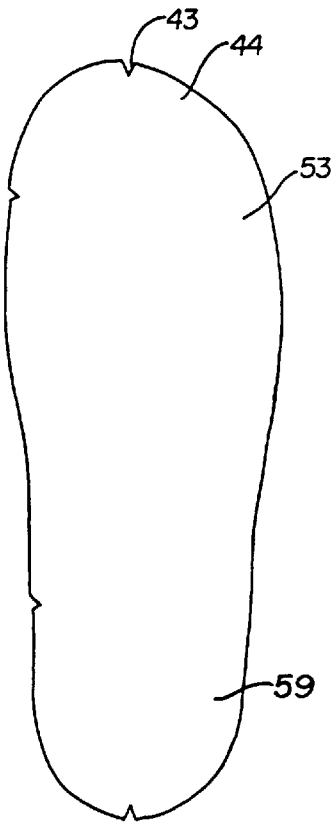
FIG. 17 is a top plan view of the foam layer of FIG. 16.
Figure 16:
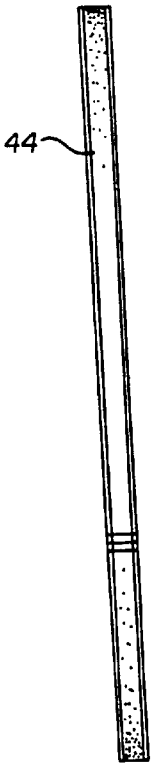
FIG. 16 is a side view of a foam layer that is included in the insole of the slipper of FIG. 1.

A heel lift 45 is illustrated in FIGS. 18–19. The heel lift 45 will be attached to the insole 16 to provide additional heel support and lift for the wearer. Notches 43 assist in aligning the heel lift with the insole 16.

Figure 21:
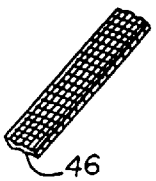
FIG. 21 is a perspective view of a securement strap that is a part of the slipper of FIG. 1.
Figure 20:
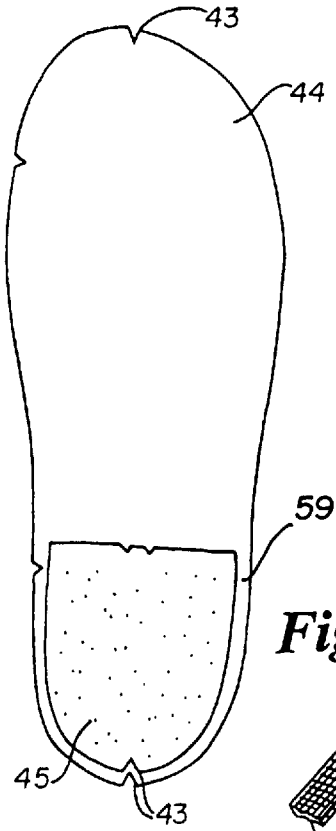
FIG. 20 is a top plan view of a partial assembly of the insole of the slipper of FIG. 1.

An insole securing strap 46 is illustrated in FIG. 21. The insole securement strap 46 may be made of an elastic material in one embodiment of the present invention. The strap 46 may be used to secure the insole 16 to the vertical sidewall 24 at the rear most heel portion 21 of the outsole 12 by stitching. An extended strap 49 may also be used that could be attached at the toe 23 and heel 21 of the outsole 12 as shown in FIG. 23A. An insole 16 may then be secured to the extended strap 49 by adhesive or stitching. The extended strap 49 may also be made of an elastic material in one embodiment.

Figure 9:
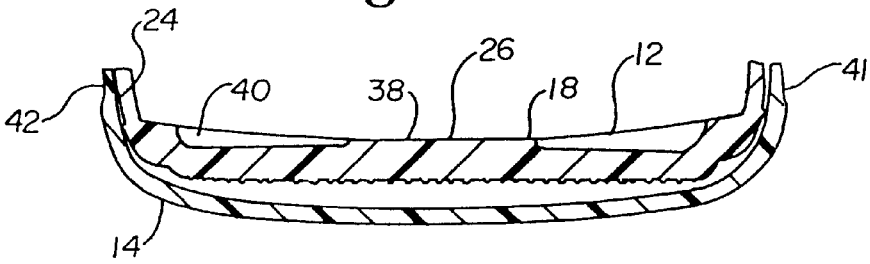
FIG. 9 is a sectional elevation of the vamp and outsole of the slipper of FIG. 1 during assembly taken along line 9—9 in FIG. 8.
Figure 8:
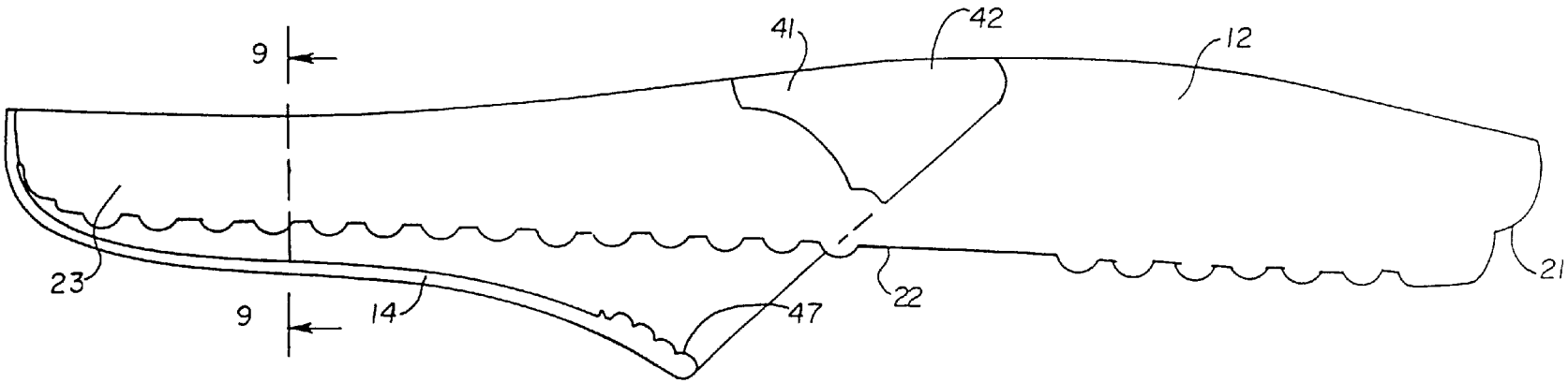
FIG. 8 is a side elevational view of the vamp and the outsole of the slipper of FIG. 1 during a first assembly step.

Now referring to FIGS. 8–23, a method of manufacture of molded slipper 10 will now be illustrated. Assembly may commence with the attachment of the lower perimeter 41 of the vamp 14 to the toe region 23 and instep region 22 of the outsole vertical sidewall 24. The vamp 14 is not attached to the heel region 21 of the outsole 12. This attachment is done with the vamp 14 being inverted so that the top surface of the vamp 14 is held in position against the outsole bottom surface 27 of the outsole 12 as shown in cross-section in FIG. 9. Any molded design elements 47 are therefore facing the outsole bottom surface 27 as illustrated in FIG. 8. Stitching of the two perimeter surfaces is now performed through the lower perimeter 41 of the vamp and the vertical sidewalls 24 of the outsole. In FIG. 8, a portion of the vamp 14 is cutaway to reveal the outsole 12 behind. Stitching 34 as shown in FIGS. 10 and 11 securely attaches the vamp 14 to the sidewall 24. In FIG. 10, a small portion of the vamp 14 is shown in cross-section near the toe region 23. Many different stitch types may be used for stitching 34 that secure the vamp 14 to the sidewall 24. The stitch type shown in the figures is preferred and is considered to provide ornamentation to the slipper 10.

Features of the vamp 14 make reverse attachment of the vamp 14 to the outsole 12 possible. The taper area 42 along the bottom perimeter 41 of the vamp 14 provides an alignment feature which is critical to an operator who is sewing blindly. This feature provides a means to maintain the depth of the vamp in the outsole, therefore ensuring fit is maintained. If the vamp is positioned and stitched too far down in the outsole, then the overall product will be too snug to the wearer across the top of the foot.

Figure 12:
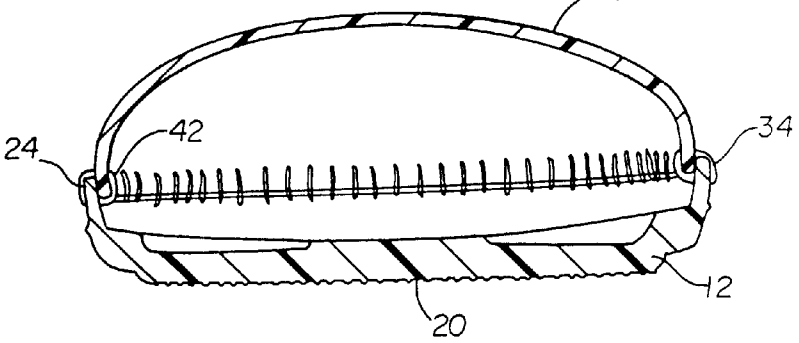
FIG. 12 is a sectional elevation similar to FIG. 11 after the vamp has been turned during assembly.
Figure 13:
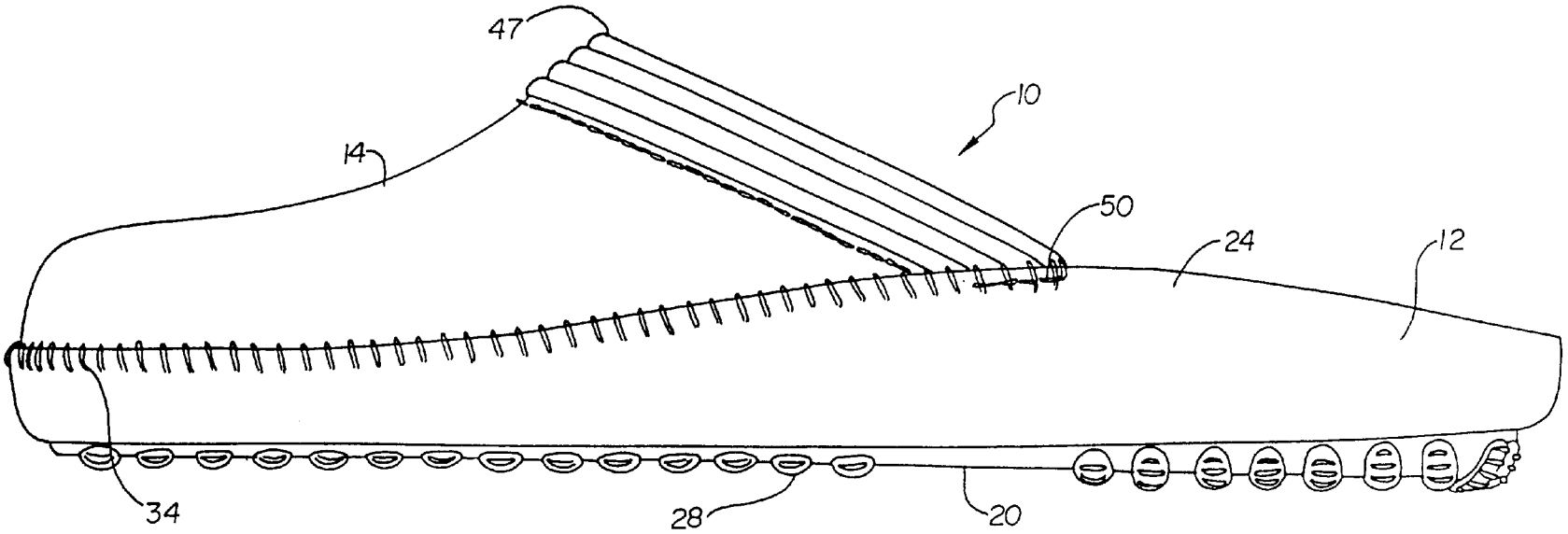
FIG. 13 is a left side elevation view of the slipper of FIG. 1 during assembly.

Further, the taper area 42 reduces the thickness of the vamp to match that of the outsole sidewall 24. The combined thickness of the taper area 42 of the vamp and the sidewall 24 is approximately equivalent to the thickness of the remainder of the vamp. This allows the vamp 14 to be turned and snapped into position behind the vertical sidewall of the outsole in the closed toe product, as illustrated in FIG. 12 and FIG. 13. FIG. 12 shows a cross-sectional view of the partially assembled slipper 10 taken near the heel portion 21 of the vamp 14. As shown in FIG. 12, the vertical sidewall 24 of the outsole 12 is outside of the taper portion 42 of the vamp 14. Stitching 34 secures the vamp 14 to the outsole 12 at the vertical sidewall 24. FIG. 13 shows a side view of the slipper 10 after the vamp has been turned. The rearward extremities of the vamp are now stitched horizontally through the vertical sidewall 24 of the outsole a second time, as shown by stitching 50 in FIG. 13. Stitching 50 provides additional strength at these stress points, to prevent the vamp from tearing away from the outsole 12 during use.

Figure 14:
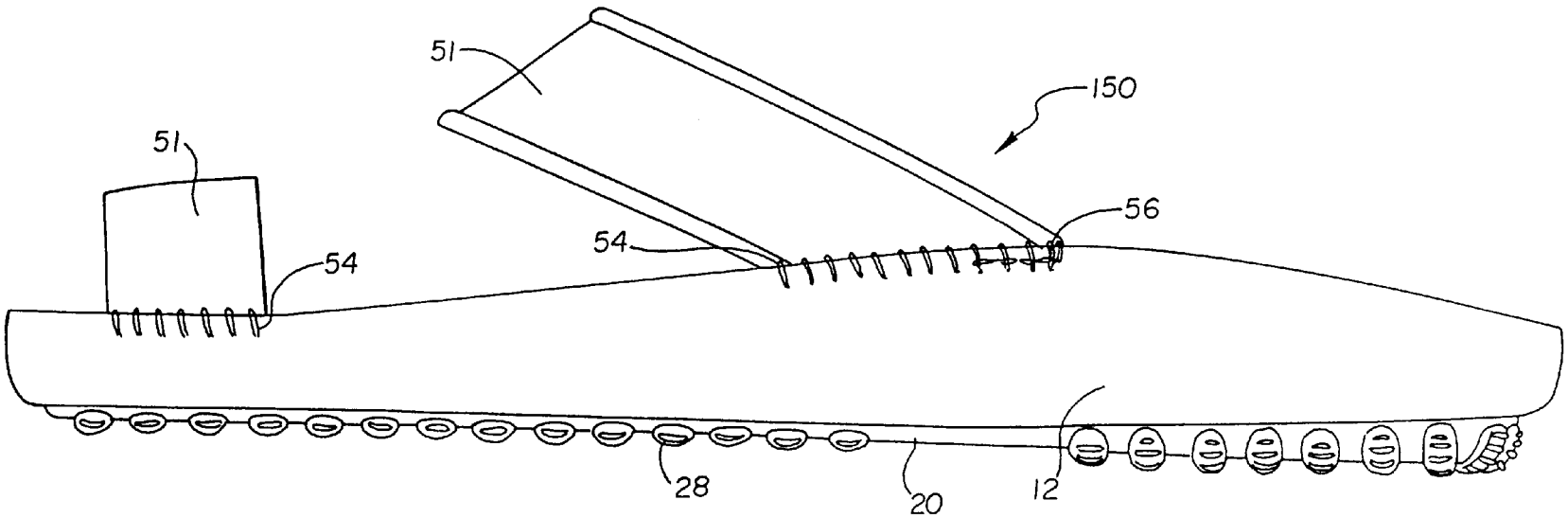
FIG. 14 is a left side elevation of an alternate embodiment of the slipper of the present invention.
Figure 15:
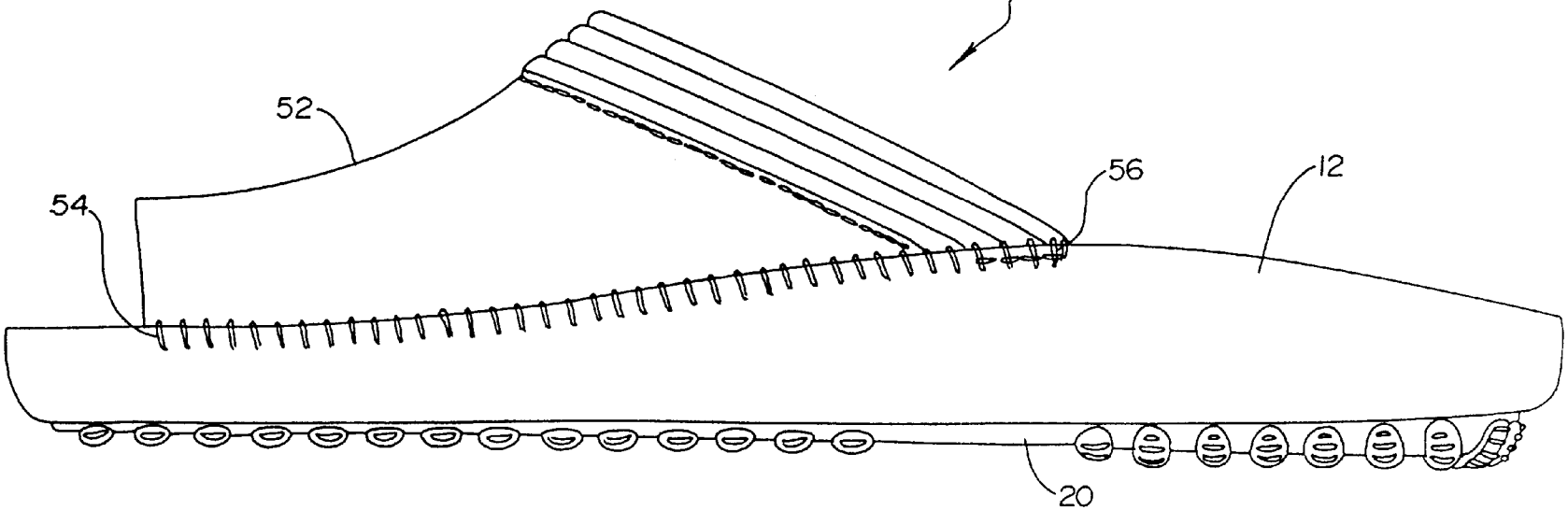
FIG. 15 is left side elevation of an alternate embodiment of the slipper of the present invention.

Although attachment of the closed toe vamp 14 requires stitching in an inverted position, attachment of sandal straps 51 or open toe upper 52 may be done directly to and through the inside surface of the vertical sidewall 24 of the outsole 12 for open toe molded slipper 150 and molded sandal 200 in FIGS. 14 and 15. As with the closed toe vamp 14, a sandal strap 51 or an open toe upper 52 is secured to the outsole by means of stitching 54, through the lower perimeter of the vamp and the vertical sidewall 24 of the outsole. Reinforcing stitching 56 is also used in slippers 110, 150. Both the sandal straps 51 and the open toe upper 52 are tapered at the lower perimeter to allow for alignment with the outsole 12. Stitching of these alternative uppers may be done using a variety of stitch types through the vertical sidewall of the outsole.

Figure 22:
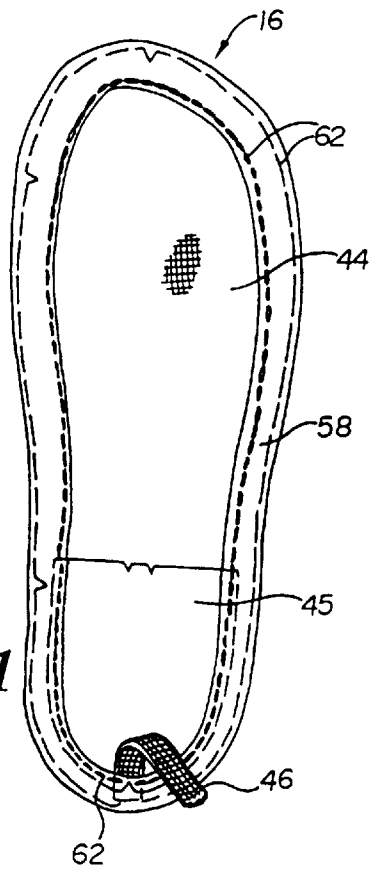
FIG. 22 is a top plan view of a further partial assembly of the insole of the slipper of FIG. 1.

Now referring to FIGS. 16–24, the insole 16 includes a foam layer 44 covered by a piece of backing fabric 53. During the binding operation of the insole 16, a strip of binding fabric 58 is placed to cover the edge of the foam layer 44, and wrap around the edges of the foam layer 44. The heel lift 45 is placed near a heel portion 59 of the foam layer 44, to be sewn to the foam layer 44 with the binding fabric 58. The strap 46 is placed near the heel end of the insole 16, also to be stitched into the binding stitch line around the entire perimeter of the insole 16. Stitching 62 thus binds the fabric 58 to the edge of the foam layer 44, and secures the heel lift 45 to the strap 46 and to the foam layer 44. This binding operation of the insole is illustrated in FIG. 22.

Figure 23:
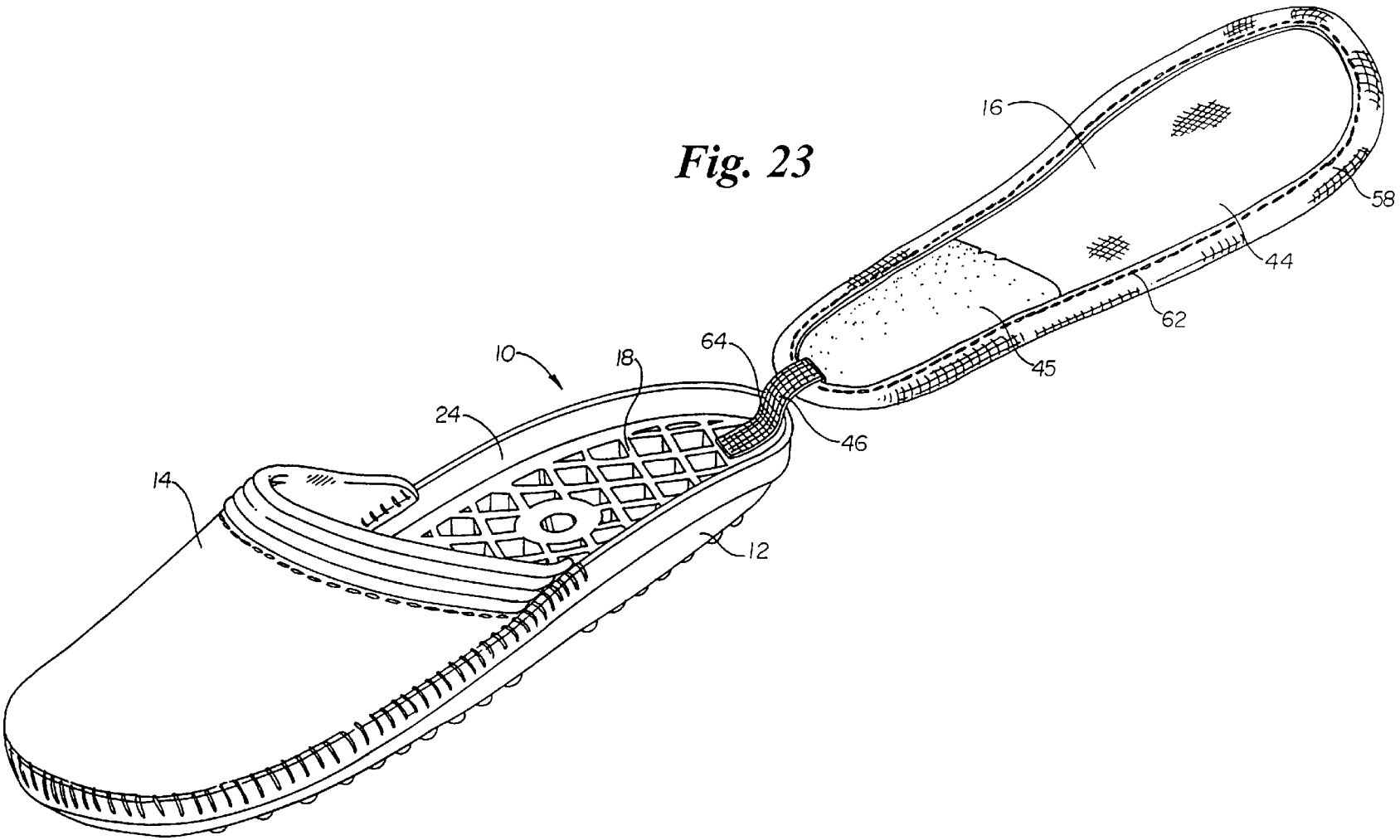
FIG. 23 is a perspective view of a further assembly step of the slipper of FIG. 1.
Figure 23A:
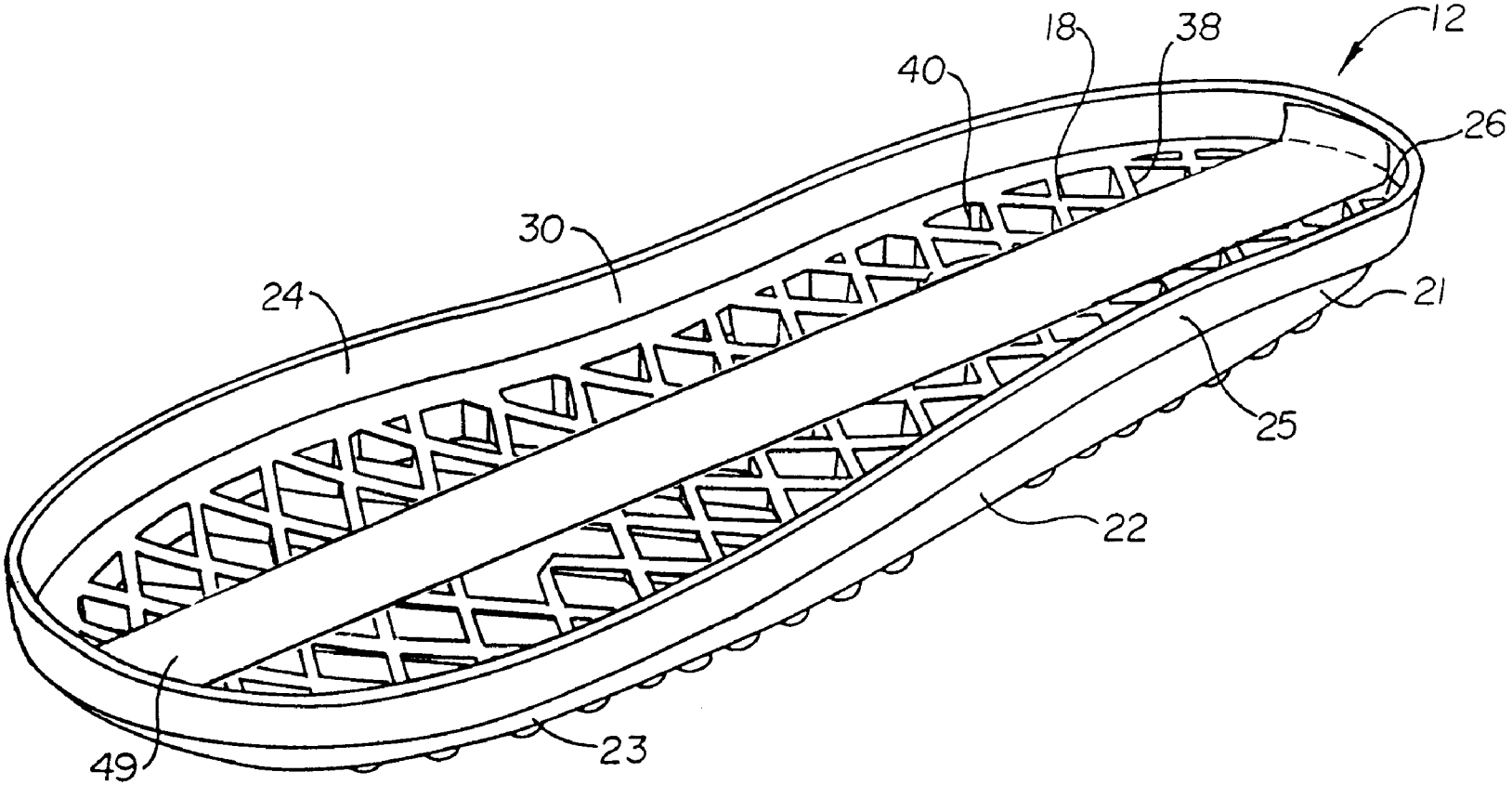
FIG. 23A is a perspective view of an assembly step of the slipper of FIG. 1 using an alternate securement strap.

One end of the heel strap 46 is then attached through the vertical sidewall 24 in the heel area by stitching 64 as shown in FIG. 23. The heel strap 46 thus secures the insole 16 to the outsole, preventing the insole 16 from sliding under a wearer's foot during walking. The attachment of the insole may be provided at only the heel portion, so it is possible to remove water from the outsole framework. If water becomes logged in the recesses 40 of the outsole 12, the insole 16 may simply be pulled back from the outsole surface, while remaining attached at the heel. The user may empty water from the recesses 40 of the outsole 12, and then reinsert the insole 16 into the slipper. The fact that the insole 16 is not adhered or sealed to the outsole around its entire perimeter allows further circulation of air throughout the outsole's chambers to allow for evaporation of moisture.

The insole 16 may also be attached by means of an extended securement strap 49 extending from heel to toe on the outsole 12. This strap 49 may be attached at the heel and toe by stitching through the outsole sidewall 24 as shown in FIG. 23A. The insole is then secured to this strap by adhesive or stitching. The extended securement strap 49 also allows for the evacuation of water from open cells 40 by the wearer as the insole is not adhered around its perimeter to the outsole. Circulation of air is also encouraged throughout the outsole's chambers because insole 16 is not sealed to the outsole 12 around the entire insole perimeter.

According to these construction steps, a slipper 10 of FIG. 1 is completed having a molded upper 14 and a molded outsole 12 having lattice walls 38. The outsole 12 also includes a vertical sidewall 24 as shown in FIG. 23. The vertical sidewall is heightened to allow for inversely attaching the molded upper 14 to the outsole 12, and for providing a secure attachment between the upper and the outsole 12.

The sidewall 24 is further intended to provide a framed surface 18 into which an insole 16 is seated and attached. This frame created by the sidewall 24 allows for a foam cushion to be securely placed with a molded outsole product. The molded slipper 10 provides an aesthetically pleasing appearance similar to that of a one piece molded slipper, but allows for light weight construction of the outsole, securement of a foam cushioning insole 16, and easy drainage of open cells 40. These advantages result because the slipper 10 is made from a manufacturing process where separate vamp 14 and outsole 12 members are molded, and are then combined with an insole in a sewing process.

Now referring to FIGS. 24–36, the slipper 100 includes three general components which can be identified as the outsole 12, the vamp 102 and the insole 104. The combination of the vamp 102 and the insole 104 can be referred to as the upper 106. The slipper 100 possesses a finished edge that is typically achieved by using a separate piece of cloth or leather binding attached around the perimeter of an insole or outsole to which an upper has been attached by means of lasting. The slipper 100 according to the present invention includes an upper that is attached through the vertical sidewall of the outsole. Previous open-toe slippers have frequently had uppers that were attached through the bottom of the outsole so that the stitching was perpendicular to the bottom surface of the product. The slipper 100 therefore provides the advantage of the final appearance of a bound construction without the use of a separate piece of cloth binding.

Figure 25:
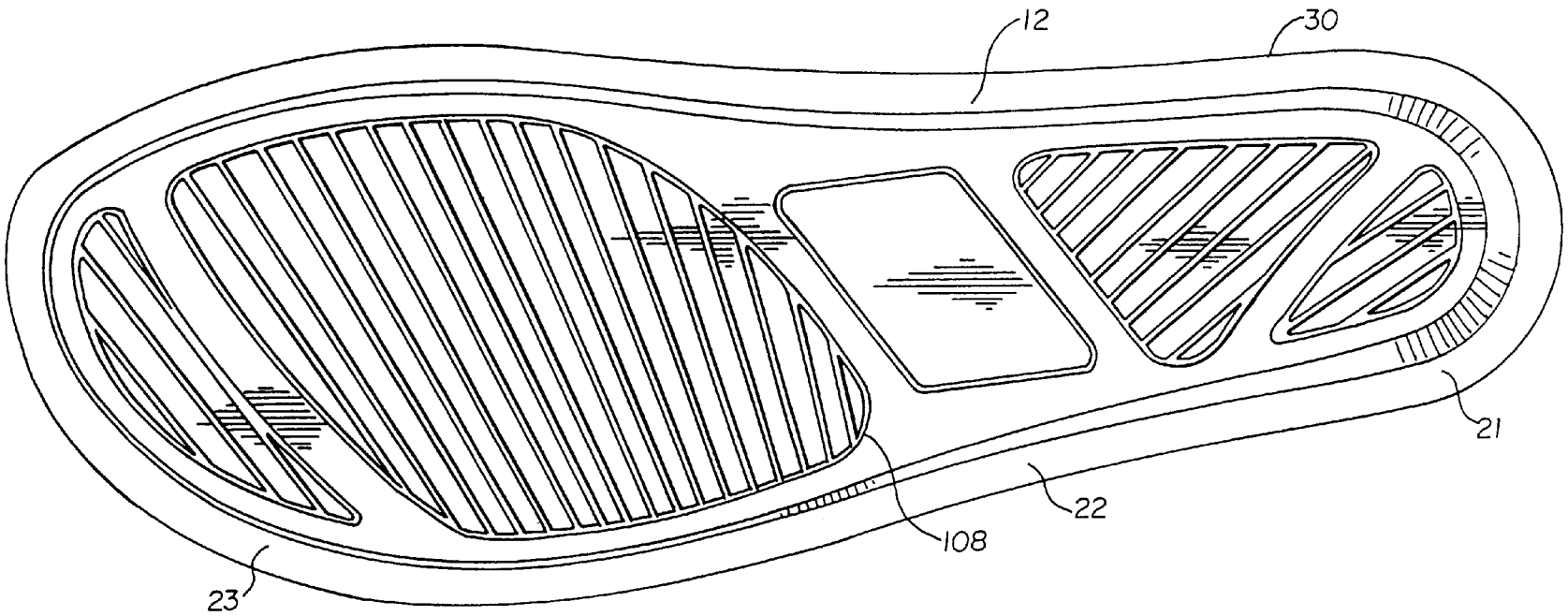
FIG. 25 is a bottom plan view of the outsole of the slipper of FIG. 24.
Figure 26:
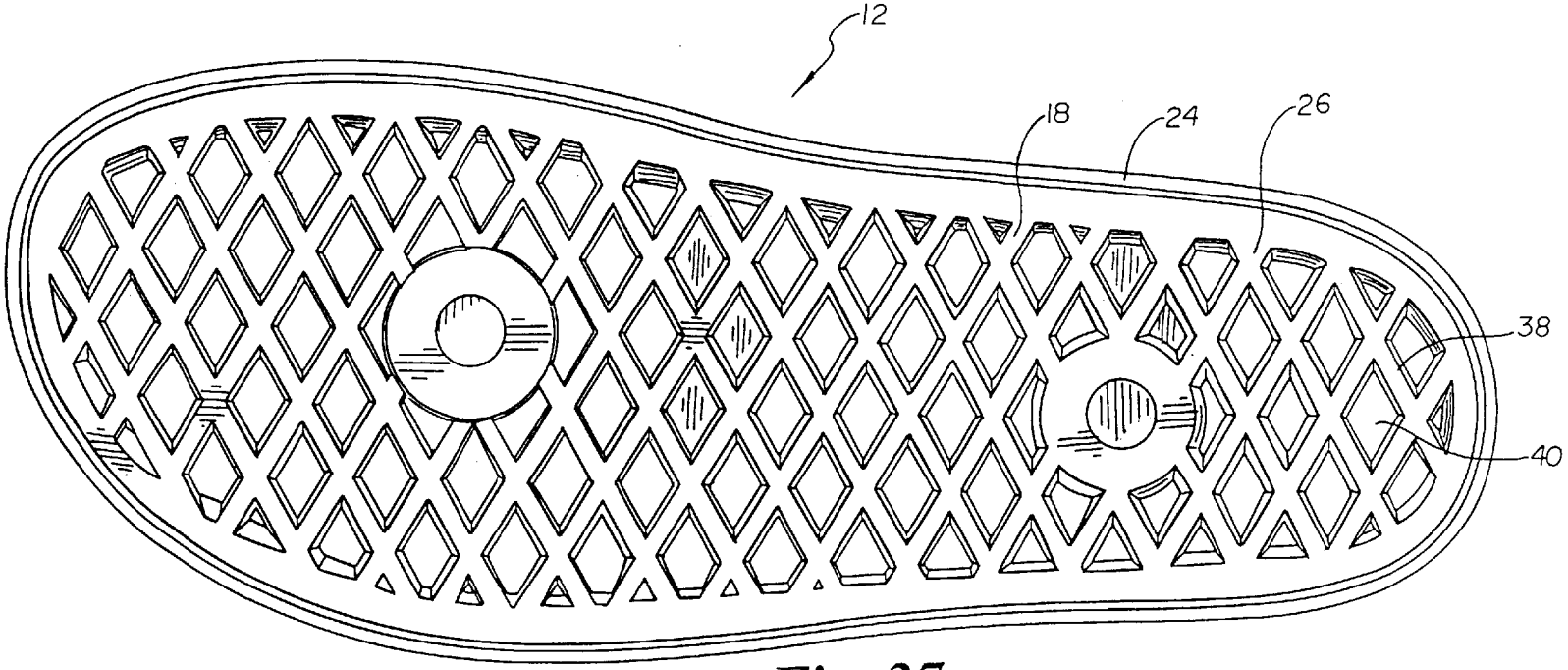
FIG. 26 is a top plan view of the outsole of the slipper of FIG. 24.
Figure 27:
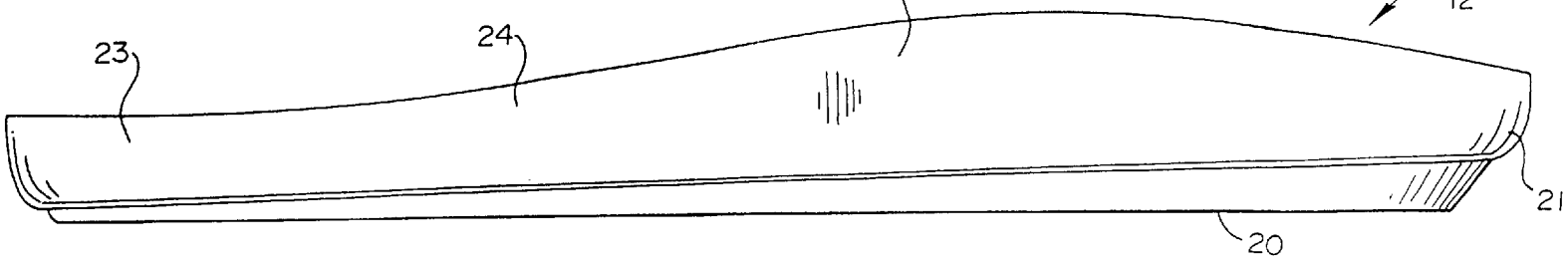
FIG. 27 is a side elevational view of the outsole of the slipper of FIG. 24.

The outsole 12 of the slipper 100 is identical to the outsole 12 included in slipper 10. Outsole 12 is illustrated in FIGS. 2–6 and 25–27. An alternative tread pattern 108 on the exterior surface 20 of the outsole 12 is shown in FIG. 25, any many different tread patterns may be used.

Now referring to FIGS. 28–35, the upper 106 is described in detail. Components of the upper 106 include a sock 109, a vamp 102, a vamp lining 120, and a sole filler 110. The sock 109 includes a fabric surface 111 that will contact the wearer's foot as the foot is supported by the interior surface 18 of the outsole 12. The vamp 102 possesses forward projections 122 and rearward projections 124 which are utilized during the manufacturing process. The vamp lining 120 is designed to be the mirror image of the vamp 102. The internal perimeter of these projections 122, 124 will be inseamed to the internal perimeter of the similar projections 126, 128 on the vamp lining 120, and then turned inside out to produce a smooth finished top edge. The inseam projections will then be stitched together and to the outsole 12 at the vertical sidewall 22, as is described further herein.

Figure 28:
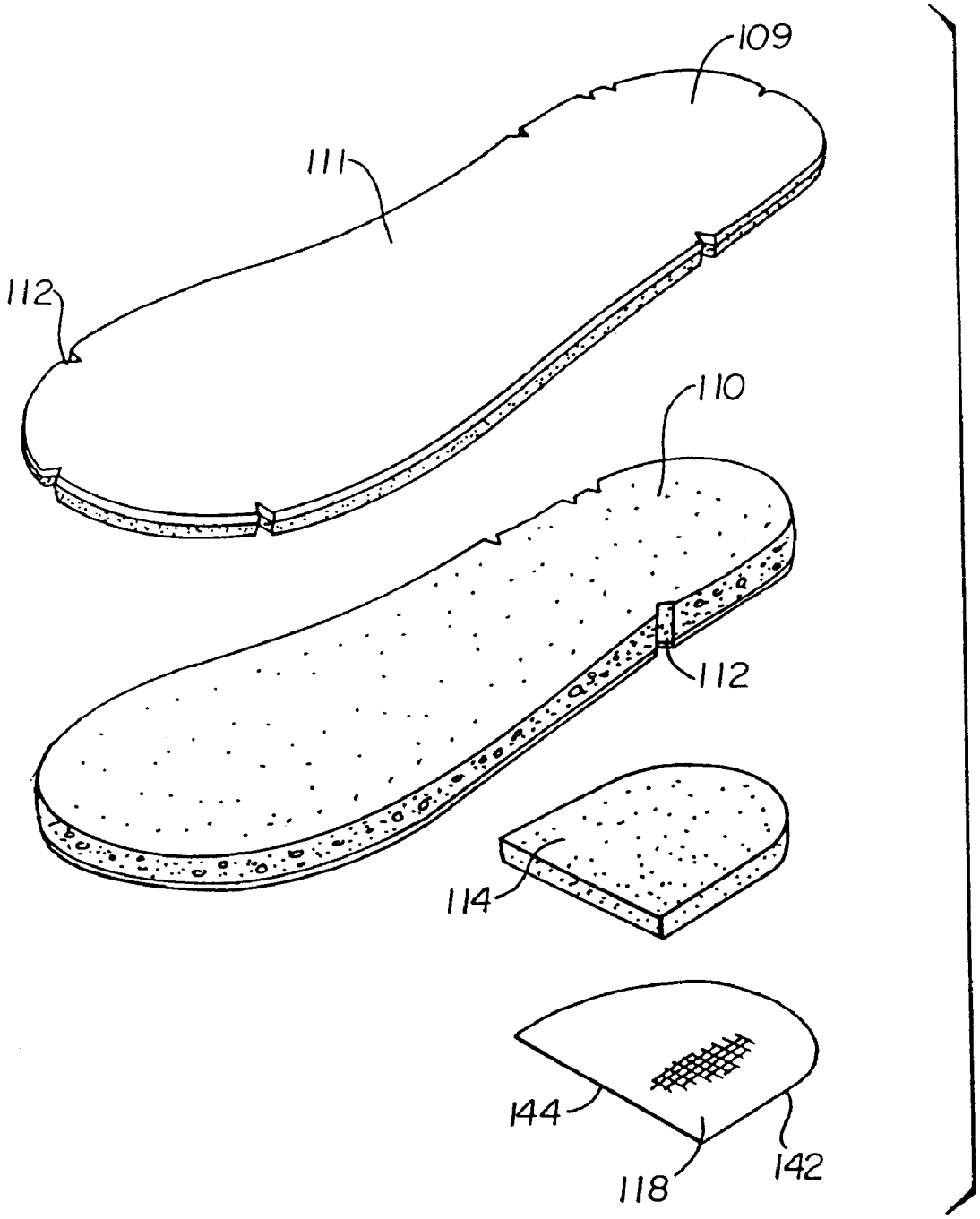
FIG. 28 is an exploded view of a pre-assembly position of the insole of the slipper of FIG. 24.

Now referring to FIG. 28, the insole 104 will be described. The insole 104 includes a sock 109, an insole filler 110, a heel filler 114, and a heel pocket 118. The sole filler 110 is a foam material layer shaped to fit into the outsole 12, and may include fabric backing on one or more sides. The sole filler 110 and sock 109 include notches 112 on the edges in order to assist in alignment with other components. The heel filler 114 may be a layer of resilient material, such as a denser foam than is used for the sole filler 110. The heel filler 114 will be attached to the sole filler 110 at a heel portion 116. A heel pocket 118 is made of a thin fabric material and is slightly larger than the heel filler 114 in a similar shape.

Now referring to FIGS. 24–32, one embodiment of the method of construction of the open toe slipper 100 is illustrated.

Figure 29:
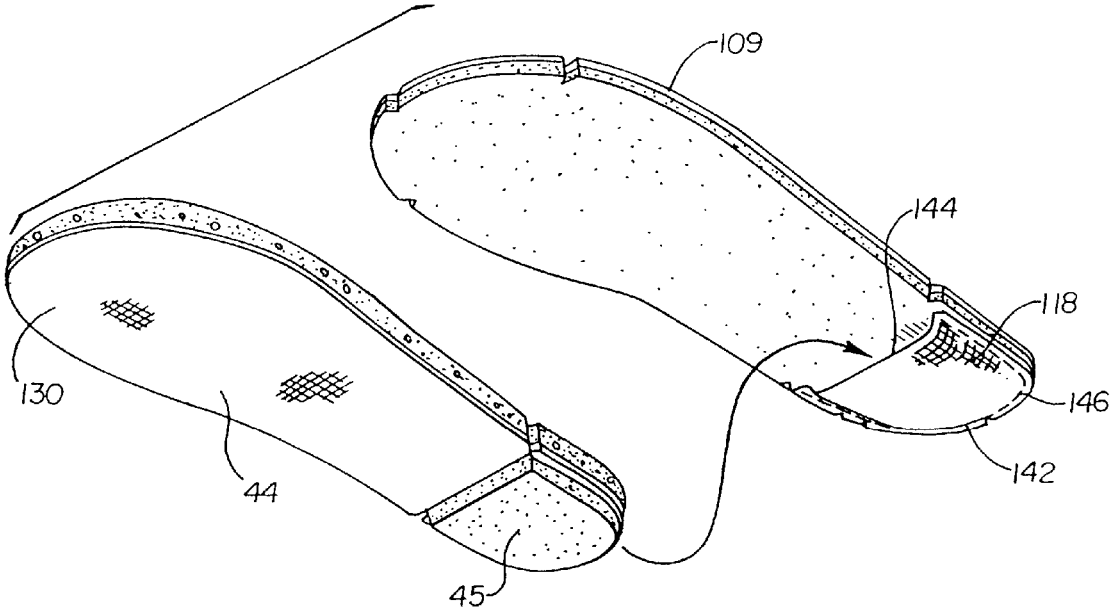
FIG. 29 is a perspective view of assembly steps involving the components of FIG. 28.
Figure 30:
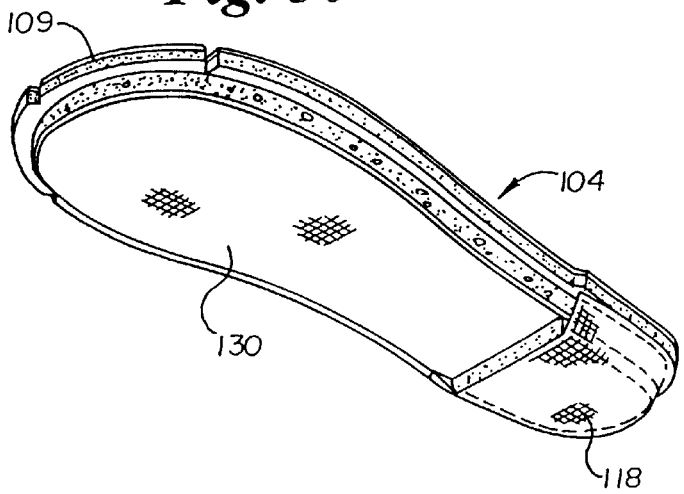
FIG. 30 is a perspective view showing the assembled insole of the slipper of FIG. 24.

The heel filler 114 and the sole filler 110 are attached to create a combined filler 130 as shown in FIG. 29, using an attachment method such as applying adhesive. Although use of adhesive is a preferred bonding method for joining the heel filler 114 to the sole filler 110, it will be appreciated that many different attachment methods are available and could be used with the present invention. The heel pocket 118 may be attached to the perimeter edge of a heel region of the sock 109, by stitching 146, for example. The heel pocket 118 is sewn to an outer curved edge 142 of the sock 109. The inside upper straight edge 144 of the heel pocket 118 is not attached to the sock 109. The combined filler 130 can thus be inserted into the heel pocket 118 as shown in FIG. 30.

Figure 31:
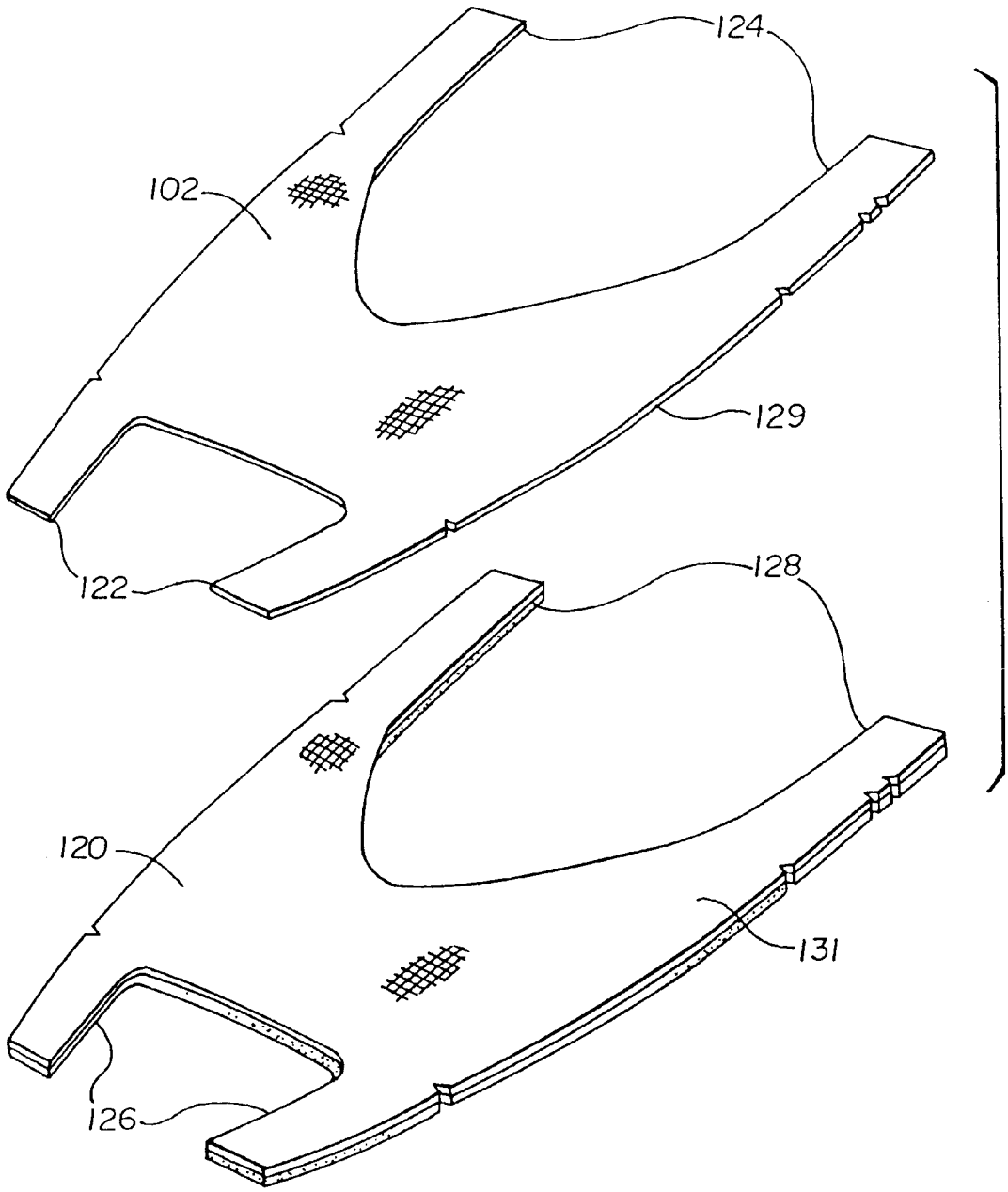
FIG. 31 is an exploded perspective view of the components of the vamp of the slipper of FIG. 24.
Figure 32:
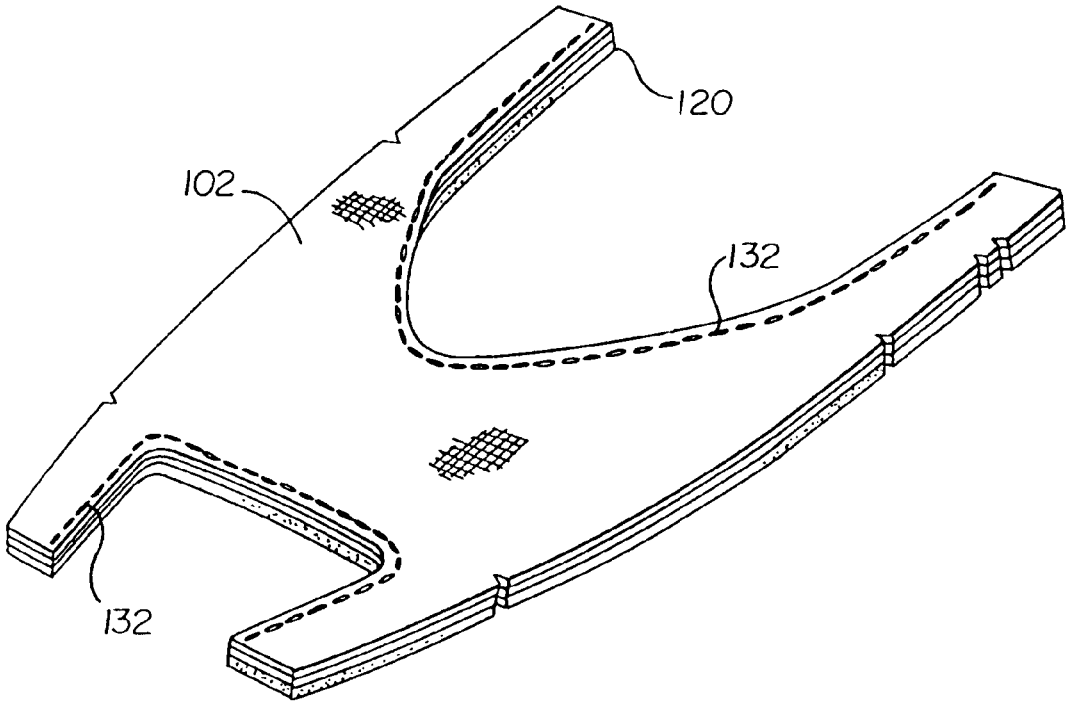
FIG. 32 is a perspective view of the vamp during assembly of the slipper of FIG. 24.

As shown in FIG. 31, the vamp 102 and the vamp liner 120 are placed so that an outer surface 129 of the vamp and an outer surface 131 of the vamp liner are facing each other. Inseam stitching 130 is performed around the inside edges of the forward projections 122, 126 and the rearward projections 124, 128 as shown in FIG. 32. The vamp 102 and the vamp liner 120 are then turned inside out so that the outer surface 129 of the vamp 102 and the outer surface 131 of the vamp liner 120 are exposed. Finished seamed edges are then visible from the outside due to stitching 132, which is now hidden.

Figure 33:
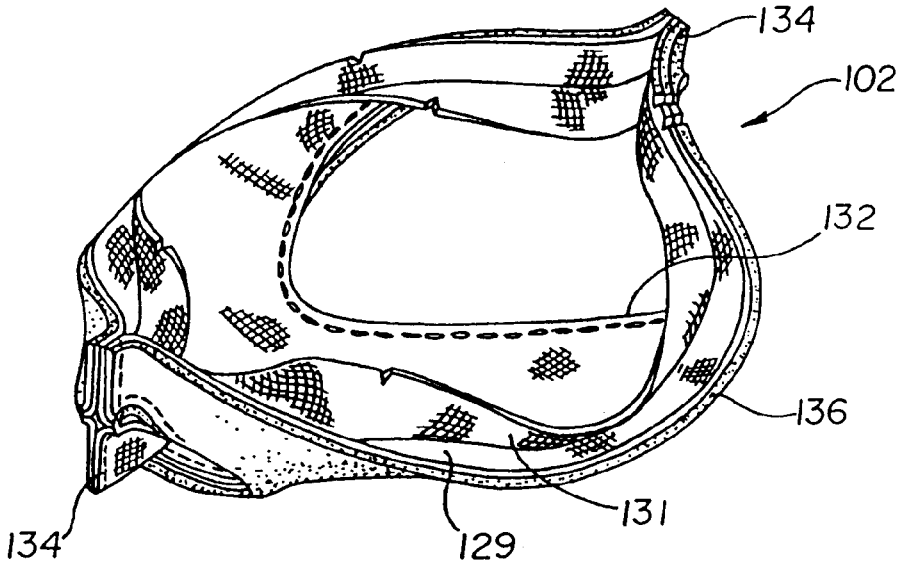
FIG. 33 is a perspective view of further assembly steps involving the vamp of the slipper of FIG. 24.

Once inseamed, the combined vamp and lining, or upper 106 are then stitched together across the two extremities ends using stitching 134 in FIG. 33. This stitching results in a combined vamp 102 and vamp liner 120 with an encasement around the forward and rear sections as shown in FIG. 33. This upper 106 is then stitched closed around the bottom perimeter 136 as shown by stitching 138.

Figure 34:
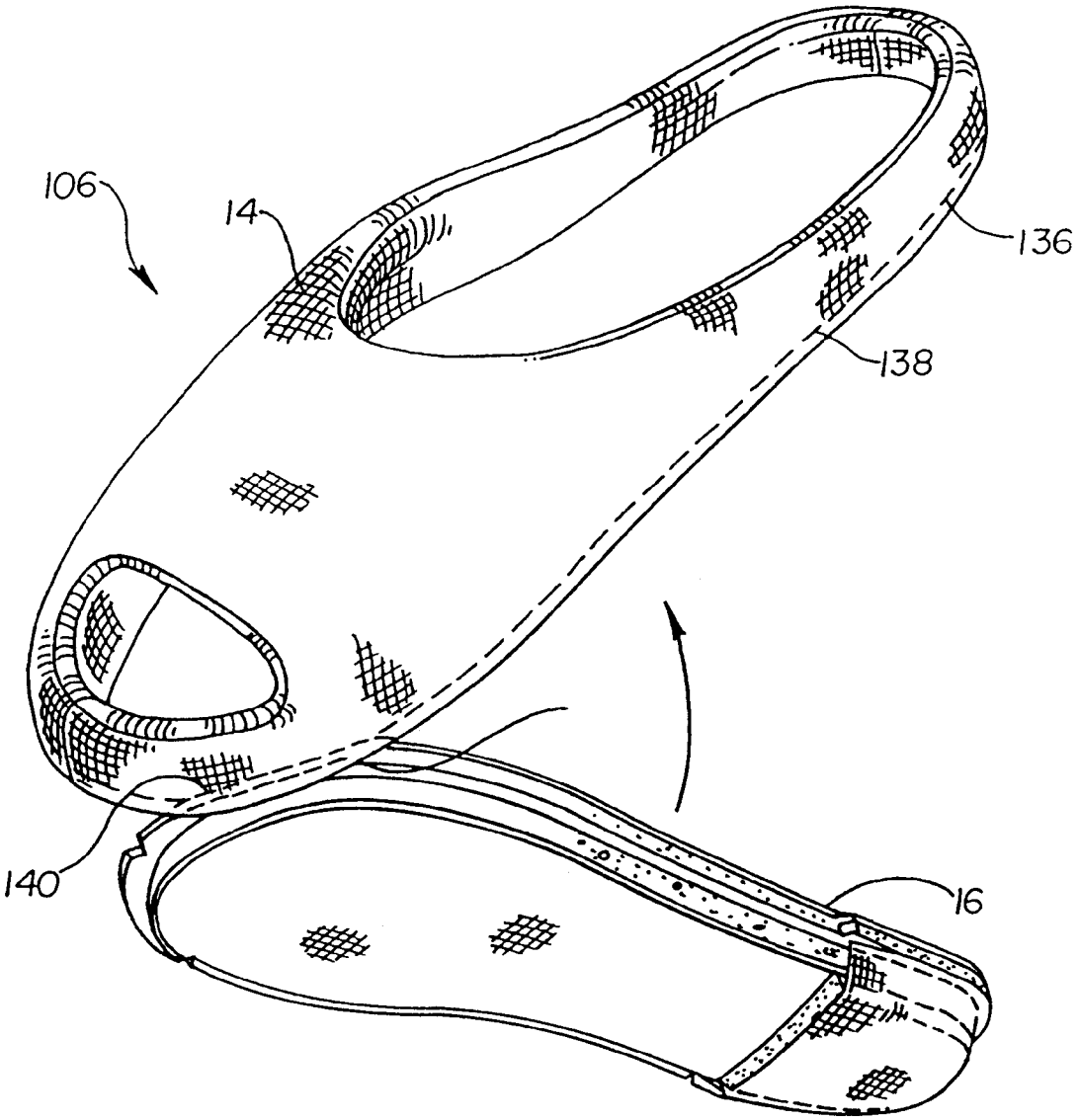
FIG. 34 is a perspective view of assembly steps involving the vamp and the insole of the slipper of FIG. 24.
Figure 35:
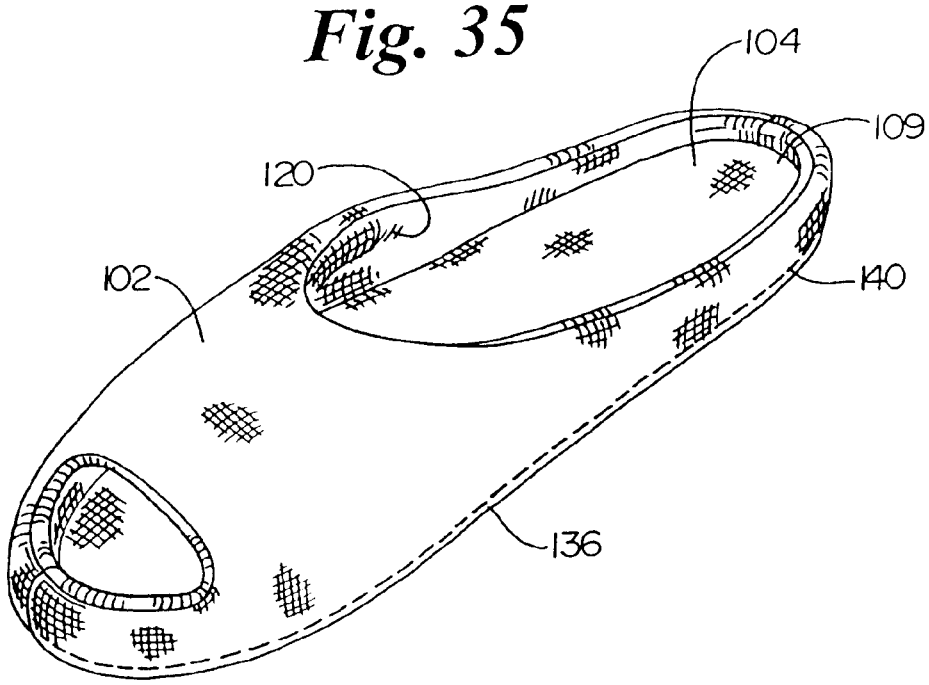
FIG. 35 is a further assembly view of the components of FIG. 34.
Figure 36:
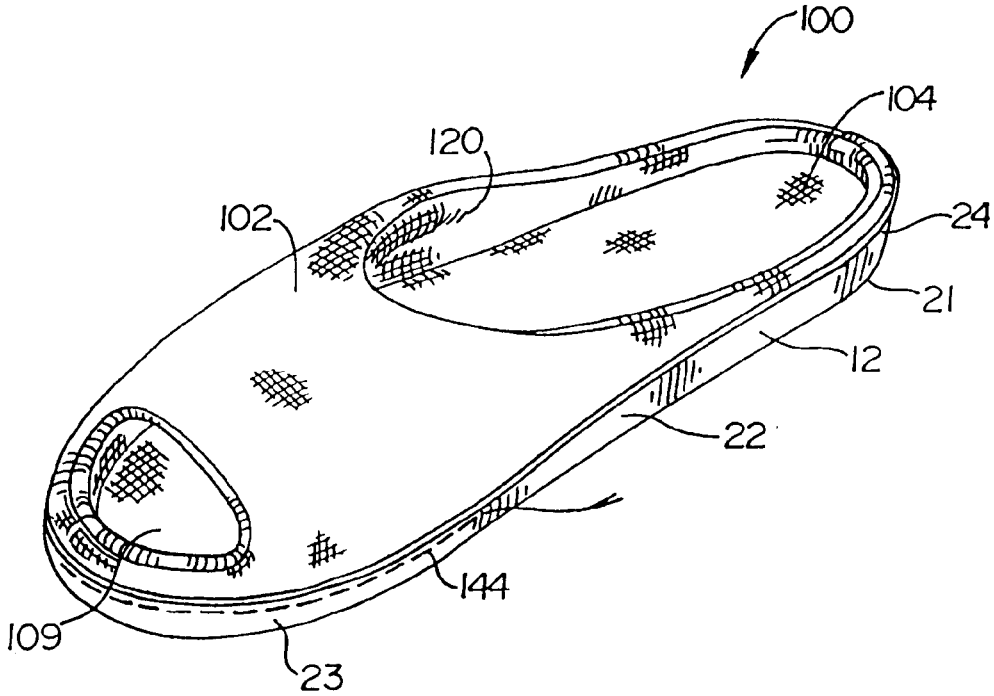
FIG. 36 is a perspective view of the final assembly steps of the slipper of FIG. 24.

The vamp may be joined to the sock 109, by stitching 140 as shown in FIG. 34. The order of many of the assembly steps may be changed within the scope of the present invention. For example, the heel pocket 118 may be attached to the sock 109 after the vamp 102 is sewn to the sock 109. Other assembly step variations are also possible for the present invention.

Figure 24:
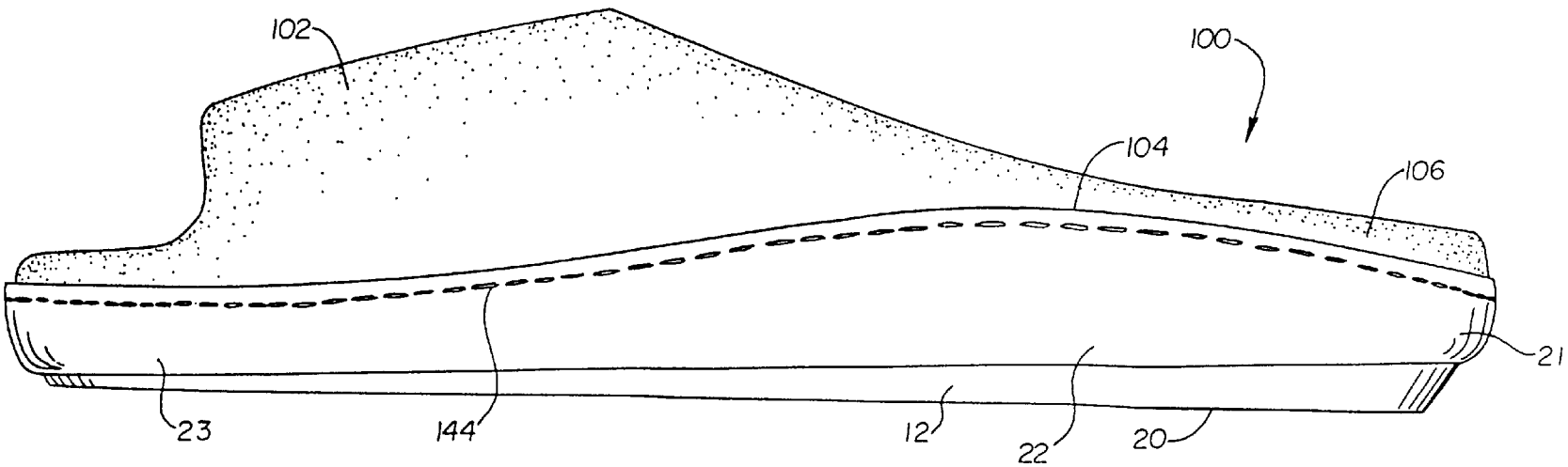
FIG. 24 is a perspective view of a fully assembled alternate embodiment of the slipper of the present invention.

The upper 106 is secured on the platform surface 18 of the outsole 12. The vertical sidewalls 24 are stitched to the upper as shown by stitching 144 in FIG. 36. A completed open toe clog slipper 100 is shown in FIG. 24 that has been constructed by these previously described steps. A finished product is accomplished which provides for an open toe construction with finished edges and a perimeter that is stitched through the vertical walls of an outsole.

By combining cloth uppers having forward and rearward projections with the molded outsole 12, it is possible to construct an open toe product with a finished edge that does not require attachment of the upper through the bottom outsole. The unique construction of the present invention also allows for the final appearance of a bound construction without the use of a separate piece of cloth binding.

The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. A slipper comprising:

(a) an outsole including a heel region, an instep region, a toe region, and a perimeter extending around the heel, instep and toe regions, the outsole comprising:

(i) an outsole bottom;

(ii) a supporting sole structure extending from at least a portion of the outsole bottom in at least one of the heel, instep and toe regions to provide elevation and including cells within the supporting sole structure for reducing weight;

(iii) a sidewall provided around the outsole perimeter, the sidewall including a lip having a height sufficient for stitching a vamp thereto, the lip extending along the perimeter of the outsole; and (iv) the outsole comprises a molded polymeric material;

(b) an insole comprising a foam layer and fabric layer, the fabric layer covering the foam layer to provide a sock for contacting a wearer's foot, the insole being constructed for fitting within the sidewall of the outsole;

(c) a vamp having a vamp perimeter constructed and arranged for attachment to the outsole lip extending along the perimeter of the outsole, wherein:

(i) the vamp and the sock are sewn together along the vamp perimeter;

(ii) the vamp and the outsole are sewn together along the outsole lip extending along the perimeter of the outsole; and (iii) the vamp is constructed to provide the slipper with an open toe construction.

2. The slipper of claim 1, wherein the vamp and the outsole are sewn together by thread providing an exposed stitch along the outsole lip.

3. The slipper of claim 1 wherein the supporting sole structure includes a platform surface and the cells of the supporting sole structure extend from the outsole bottom vertically through the supporting sole structure to the platform surface.

4. The slipper of claim 1 wherein the supporting sole structure extends from at least a portion of the outsole bottom in the heel and instep regions and the supporting sole structure further comprises lattice walls, wherein the lattice walls provide the cells therebetween and the lattice walls have a height, wherein the height of the lattice walls in the heel region is greater than in the instep region.

5. The slipper of claim 1, wherein the supporting sole structure extends from the outsole bottom in the heel region, instep region, and toe regions of the outsole.

6. The slipper of claim 1 wherein the outsole further comprises a platform surface within the sidewall for supporting the insole, wherein a height of the sidewall lip is defined as the distance from the platform surface to the top of the outsole sidewall, and wherein the height of the lip is about one-sixteenth inch to about one inch.

7. The slipper of claim 6 wherein the height of the lip is about one-eighth inch to about three-eighths inch.

8. The slipper of claim 6 wherein the height of the lip is about five-sixteenths inch.

9. The slipper of claim 1 wherein the vamp further comprises a layered structure including two fabric layers surrounding a foam layer.

10. The slipper of claim 1, the vamp further comprising a first encasement that defines an open toe area.

11. The slipper of claim 10, the vamp further comprising two forward projections stitched together at the first encasement.

12. The slipper of claim 1, the vamp further comprising a second encasement that defines an open heel area.

13. The slipper of claim 12, the vamp further comprising two rear projections stitched together at the second encasement.

14. The slipper of claim 1 wherein the vamp and outsole are sewn together by stitching and the stitching extends around the entire perimeter of the outsole.

15. A method for manufacturing a slipper, the method comprising steps of:

stitching a vamp and an insole together; and stitching the vamp and an outsole together, wherein:

(a) the outsole includes a heel region, an instep region, a toe region, and a perimeter extending around the heel, instep and toe regions, the outsole comprising:

(i) an outsole bottom;

(ii) a supporting sole structure extending from at least a portion of the outsole bottom in at least one of the heel, instep and toe regions to provide elevation and including cells within the supporting sole structure for reducing weight;

(iii) a sidewall provided around the outsole perimeter, the sidewall including a lip having a height sufficient for stitching a vamp thereto, the lip extending along the perimeter of the outsole; and (iv) the outsole comprises a molded polymeric material;

(b) the insole comprises a foam layer and fabric layer, the fabric layer covering the foam layer to provide a sock for contacting a wearer's foot, the insole being constructed for fitting within the sidewall of the outsole;

(c) the vamp has a vamp perimeter constructed and arranged for attachment to the outsole lip extending along the perimeter of the outsole, wherein:

(i) the vamp and the sock are sewn together along the vamp perimeter;

(ii) the vamp and the outsole are sewn together along the outsole lip extending along the perimeter of the outsole; and (iii) the vamp is constructed to provide the slipper with an open toe construction.

16. The method of claim 15 further comprising stitching together two forward projections of the vamp to form a first encasement area that defines an open toe area, before stitching the vamp and the insole together.

17. The method of claim 15 further comprising stitching together two rearward projections of the vamp to form a second encasement area that defines an open heel region, before stitching the vamp and the insole together.

18. The slipper of claim 11 wherein the two forward projections of the vamp each comprise an end distal from a remainder of the vamp, wherein the two forward projections are stitched together at their ends to form the first encasement.

19. The slipper of claim 13 wherein the two rear projections of the vamp each comprise an end distal from a remainder of the vamp, wherein the two rear projections are stitched together at their ends to form the second encasement.

20. The method of claim 16 wherein the two forward projections of the vamp each comprise an end distal from a remainder of the vamp, wherein the two forward projections are stitched together at their ends to form the first encasement.

21. The method of claim 17 wherein the two rear projections of the vamp each comprise an end distal from a remainder of the vamp, wherein the two rear projections are stitched together at their ends to form the second encasement.

* * * * *